US006140004A

United States Patent [19]

Mott et al.

[11] Patent Number: 6,140,004

[45] **Date of Patent: *Oct. 31, 2000**

[54] ORGANOPHOTORECEPTORS FOR ELECTROPHOTOGRAPHY FEATURING NOVEL CHARGE TRANSPORT COMPOUNDS

[75] Inventors: Andrew W. Mott, Uppsala, Sweden; David J. Owen, Woodbury, Minn.; Nusrallah Jubran, Saint Paul, Minn.; Martin D. Attwood, Knutsford, United Kingdom; Richard A. Barcock, Stansted Montfitchet, United Kingdom; Richard J. Ellis, High Wycombe, United Kingdom; Rachel J. Hobson, North End Nr. Gt. Dunmow, United Kingdom; David R. McGill, Chesham, United Kingdom

[73] Assignee: Imation Corp., Oakdale, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/465,023

[22] Filed: Dec. 16, 1999

Related U.S. Application Data

[62] Division of application No. 09/172,379, Oct. 14, 1998, Pat. No. 6,066,426.

[51] Int. Cl.[7] ..... G03G 5/047

[52] U.S. Cl. ..... 430/132; 430/133; 156/288

[58] Field of Search ..... 430/127, 132, 430/133, 134; 156/288

[56] References Cited

U.S. PATENT DOCUMENTS

| | | | |
|---|---|---|---|
| 4,216,286 | 8/1980 | Greene et al. | 156/288 |
| 4,256,821 | 3/1981 | Enomoto et al. | 430/79 |
| 4,278,747 | 7/1981 | Murayama et al. | 430/82 |
| 4,338,388 | 7/1982 | Sakai et al. | 430/77 |
| 4,365,014 | 12/1982 | Sakai et al. | 430/57 |
| 4,439,509 | 3/1984 | Schank | 430/132 |
| 4,451,549 | 5/1984 | Kato | 430/134 |
| 4,454,212 | 6/1984 | Sakai et al. | 430/79 |
| 4,470,861 | 9/1984 | Kravig et al. | 156/288 |
| 4,565,760 | 1/1986 | Schank | 430/66 |
| 4,595,602 | 6/1986 | Schank | 430/76 |
| 4,606,934 | 8/1986 | Lee et al. | 430/76 |
| 4,784,929 | 11/1988 | Ueda | 430/81 |
| 4,923,775 | 5/1990 | Schank | 430/66 |
| 4,968,579 | 11/1990 | Kimoto et al. | 430/134 |
| 5,098,810 | 3/1992 | Mizuguchi et al. | 430/78 |
| 5,158,850 | 10/1992 | Sasaki et al. | 430/71 |
| 5,622,800 | 4/1997 | Ando et al. | 430/83 |
| 5,650,253 | 7/1997 | Baker et al. | 430/119 |
| 5,659,851 | 8/1997 | Moe et al. | 399/165 |
| 5,756,248 | 5/1998 | Tanaka et al. | 430/83 |

FOREIGN PATENT DOCUMENTS

| | | | |
|---|---|---|---|
| 4-116566 | 9/1982 | Japan | 430/133 |
| 57-158645 | 9/1982 | Japan | 430/127 |
| 58-2849 | 1/1983 | Japan . | |
| 60-237453 | 11/1985 | Japan . | |
| 62-116943 | 5/1987 | Japan . | |
| 1-234855 | 9/1989 | Japan . | |
| 2-82263 | 3/1990 | Japan | 430/127 |
| 2-245763 | 10/1990 | Japan | 430/132 |
| 4-110857 | 4/1992 | Japan | 430/133 |

OTHER PUBLICATIONS

E. Cohen and E. Gutoff, Modern Coating and Drying Technology, VCH Publishers, Inc. New York, 1992, pp. 117–120.

Zhang, Wada and Sasabe, J. Polym. Sci. Part A: Part A: Polym. Chem. 1996, 34, 2289.

*Primary Examiner*—Roland Martin
*Attorney, Agent, or Firm*—Amelia A. Buharin

[57] ABSTRACT

An organic photoreceptor that includes:

(a) a charge transport compound having the formula (1)

where n is an integer between 2 and 6, inclusive;

$R^1$ and $R^2$, independently, are an alkyl group, a cycloalkyl group, or an aryl group, or $R^1$ and $R^2$ combine with the nitrogen atom to form a ring;

Y is a bond, a carbon atom, a —$CR^3$ group, an aryl group, a cycloalkyl group, or a cyclosiloxyl group;

$R^3$ is hydrogen, an alkyl group, or an aryl group; and

X is a linking group having the formula —$(CH_2)_m$— wherein m is an integer between 4 and 10, inclusive, and one or more of the methylene groups is optionally replaced by an oxygen atom, a carbonyl group, or an ester group;

(b) a charge generating compound; and (c) an electroconductive substrate.

20 Claims, No Drawings

ORGANOPHOTORECEPTORS FOR ELECTROPHOTOGRAPHY FEATURING NOVEL CHARGE TRANSPORT COMPOUNDS

This is a division of application Ser. No. 09/172,379 filed Oct. 14, 1998, now U.S. Pat. No. 6,066,426.

BACKGROUND OF THE INVENTION

This invention relates to organic photoreceptors suitable for use in electrophotography.

In electrophotography, a photoreceptor in the form of a plate, belt, or drum having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas, thereby forming a pattern of charged and uncharged areas. A liquid or solid toner is then deposited in either the charged or uncharged areas to create a toned image on the surface of the photoconductive layer. The resulting visible toner image can be transferred to a suitable receiving surface such as paper. The imaging process can be repeated many times.

Both single layer and multilayer photoconductive elements have been used. In the single layer embodiment, a charge transport material and charge generating material are combined with a polymeric binder and then deposited on the electrically conductive substrate. In the multilayer embodiment, the charge transport material and charge generating material are in the form of separate layers, each of which can optionally be combined with a polymeric binder, deposited on the electrically conductive substrate. Two arrangements are possible. In one arrangement (the "dual layer" arrangement), the charge generating layer is deposited on the electrically conductive substrate and the charge transport layer is deposited on top of the charge generating layer. In an alternate arrangement (the "inverted dual layer" arrangement), the order of the charge transport layer and charge generating layer is reversed.

In both the single and multilayer photoconductive elements, the purpose of the charge generating material is to generate charge carriers (i.e., holes or electrons) upon exposure to light. The purpose of the charge transport material is to accept these charge carriers and transport them through the charge transport layer in order to discharge a surface charge on the photoconductive element.

To produce high quality images, particularly after multiple cycles, it is desirable for the charge transport material to form a homogeneous solution with the polymeric binder and remain in solution. In addition, it is desirable to maximize the amount of charge which the charge transport material can accept (indicated by a parameter known as the acceptance voltage or "$V_{acc}$"), and to minimize retention of that charge upon discharge (indicated by a parameter known as the residual voltage or "$V_{res}$").

Liquid toners generally produce superior images compared to dry toners. However, liquid toners also can facilitate stress crazing in the photoconductive element. Stress crazing, in turn, leads to printing defects such as increased background. It also degrades the photoreceptor, thereby shortening its useful lifetime. The problem is particularly acute when the photoreceptor is in the form of a flexible belt included in a compact imaging machine that employs small diameter support rollers (e.g., having diameters no greater than about 40 mm) confined within a small space. Such an arrangement places significant mechanical stress on the photoreceptor, and can lead to degradation and low quality images.

SUMMARY OF THE INVENTION

In a first aspect, the invention features an organic photoreceptor that includes:

(a) a charge transport compound having the formula (1)

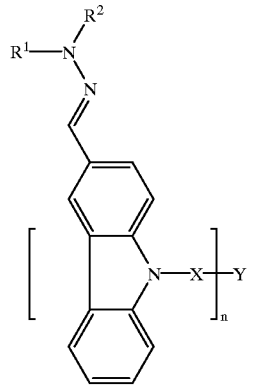

where n is an integer between 2 and 6, inclusive;

$R^1$ and $R^2$, independently, are an alkyl group (e.g., a $C_1$–$C_6$ alkyl group), a cycloalkyl group (e.g., a cyclohexyl group), or an aryl group (e.g., a phenyl or naphthyl group), or $R^1$ and $R^2$ combine with the nitrogen atom to form a ring;

Y is a bond, a carbon atom, a —$CR^3$ group (where $R^3$ is H, an alkyl group (e.g., a $C_1$–$C_6$ alkyl group), or aryl group (e.g., a phenyl or naphthyl group)), an aryl group (e.g., a phenyl or naphthyl group), a cycloalkyl group,or a cyclosiloxyl group (e.g., a cyclotetrasiloxyl group); and X is a linking group having the formula —$(CH_2)_m$— where m is an integer between 4 and 10, inclusive, and one or more of the methylene groups is optionally replaced by an oxygen atom, a carbonyl group, or an ester group;

(b) a charge generating compound; and (c) an electroconductive substrate.

When Y is a carbon atom, n=4. When Y is a —$CR^3$ group, n=3. When y is a bond, n=2.

The charge transport compound may or may not be symmetrical. Thus, for example, a linking group X for any given "arm" of the compound may be the same or different from the linking groups in other "arms" of the compound. Similarly, the $R^1$ and $R^2$ groups for any given "arm" of the compound may be the same or different from the $R^1$ and $R^2$ groups in any other arm. In addition, the above-described formula for the charge transport compound is intended to cover isomers.

The organic photoreceptor may be provided in the form of a flexible belt. In one embodiment, the organic photoreceptor includes: (a) a charge transport layer comprising the charge transport compound and a polymeric binder; (b) a charge generating layer comprising the charge generating compound and a polymeric binder; and (c) the electroconductive substrate. The charge transport layer preferably has a glass transition temperature of at least about 80° C. The charge transport layer may be intermediate the charge generating layer and the electroconductive substrate. Alternatively, the charge generating layer may be intermediate the charge transport layer and the electroconductive substrate.

In one preferred embodiment, a charge transport compound is selected in which n is 2, Y is a bond, and X has the formula —$(CH_2)_m$— wherein m is an integer between 4 and 7, inclusive. Specific examples of suitable charge transport compounds have the following formulae:

(2)

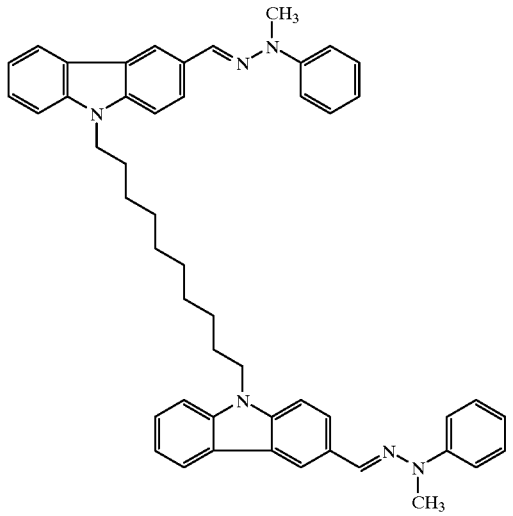

(3)

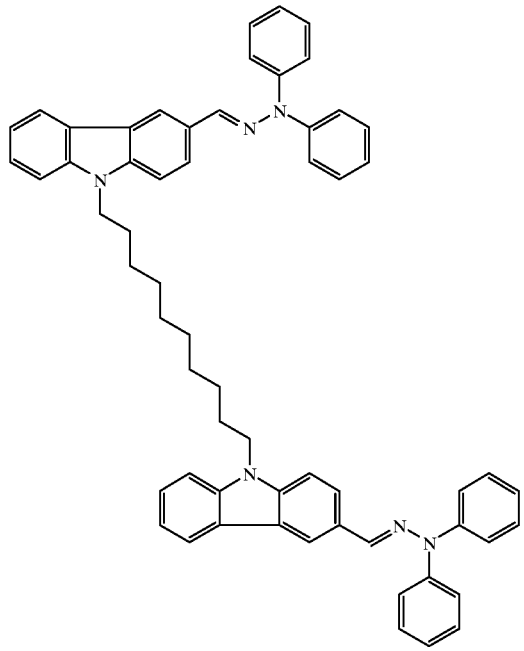

(4)

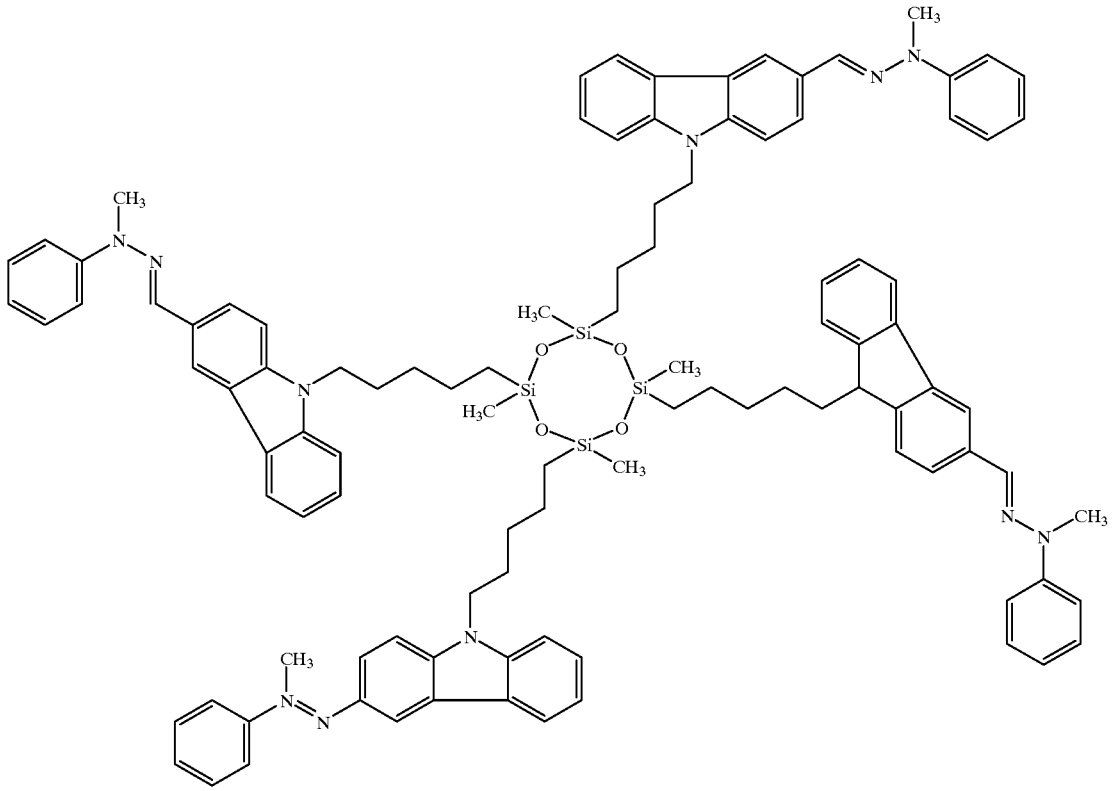

-continued
(5)
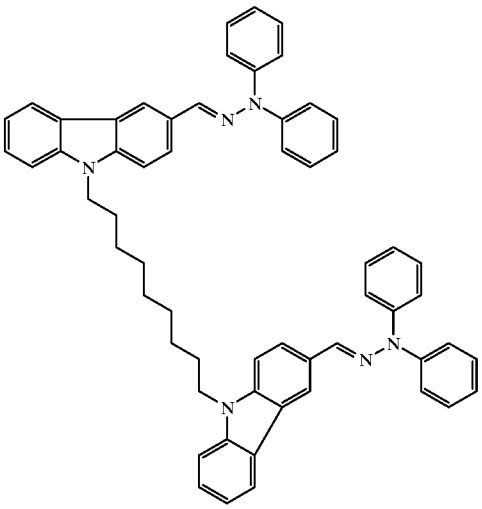
(6)
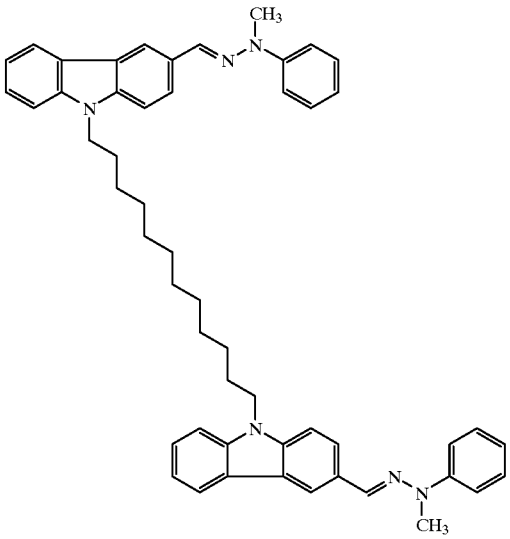
(7)
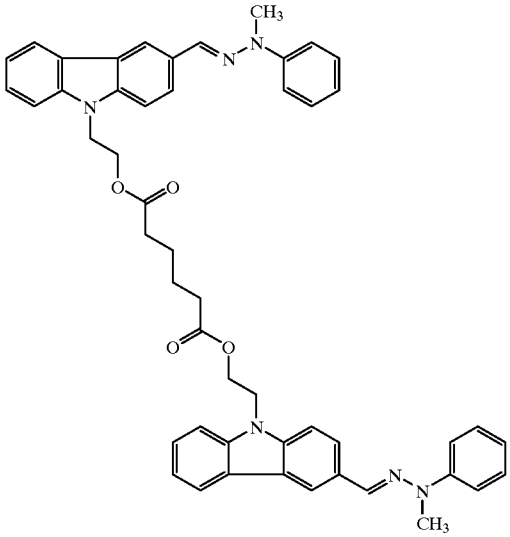
(8)
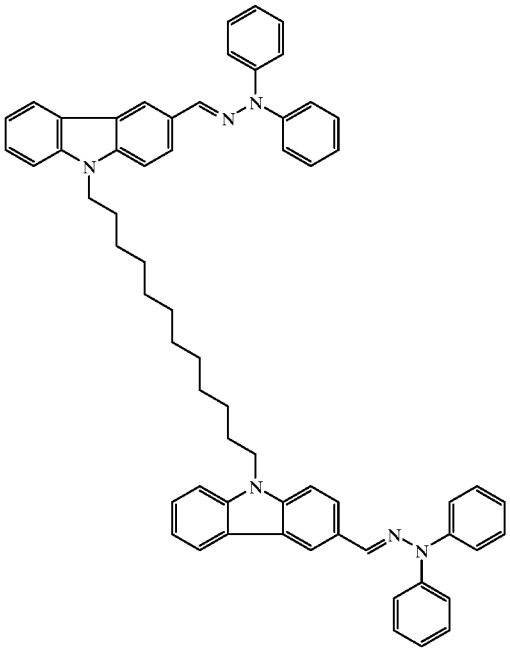

-continued
(9)
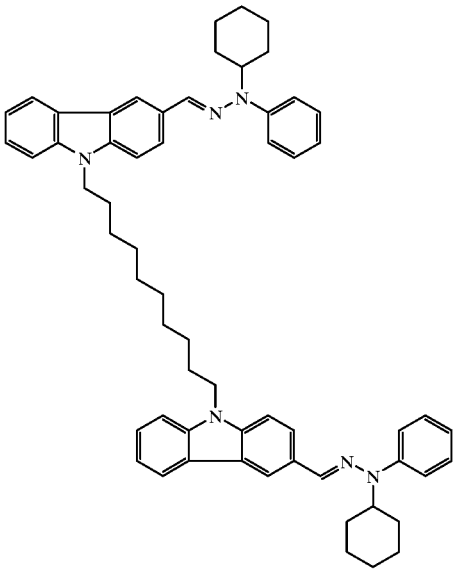
(10)
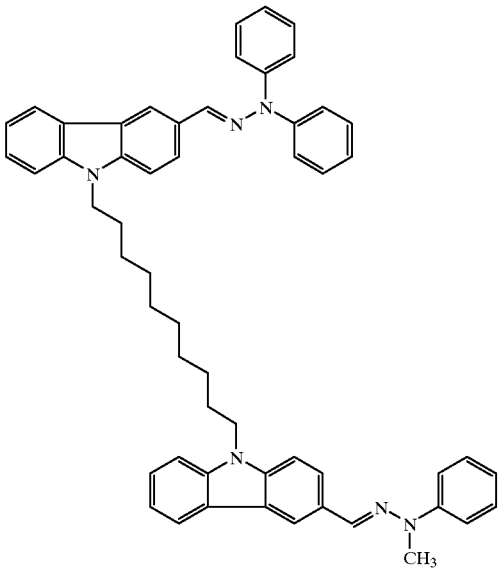
(11)
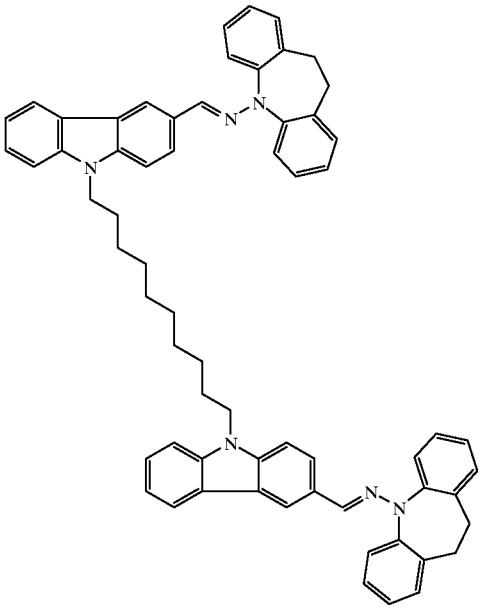
(12)
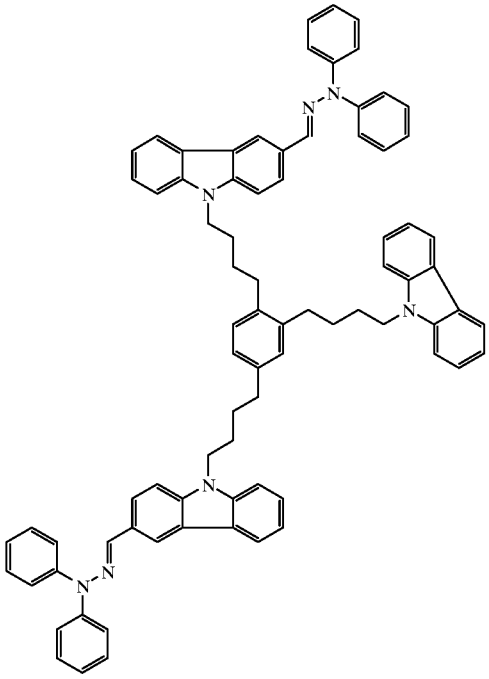

-continued
(13)
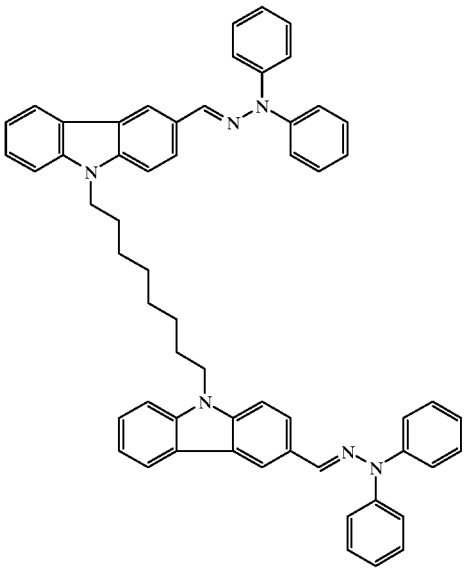
(14)
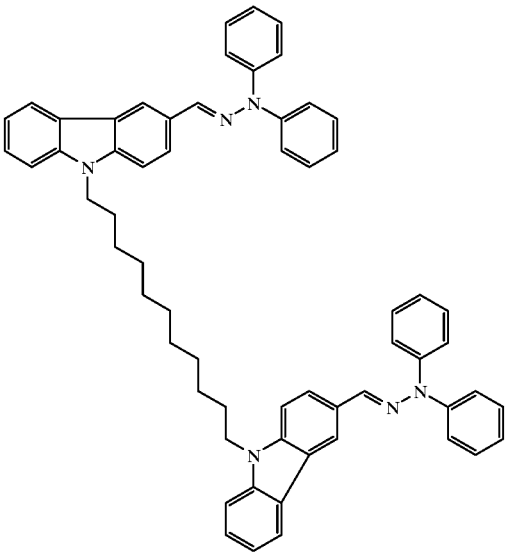
(15)
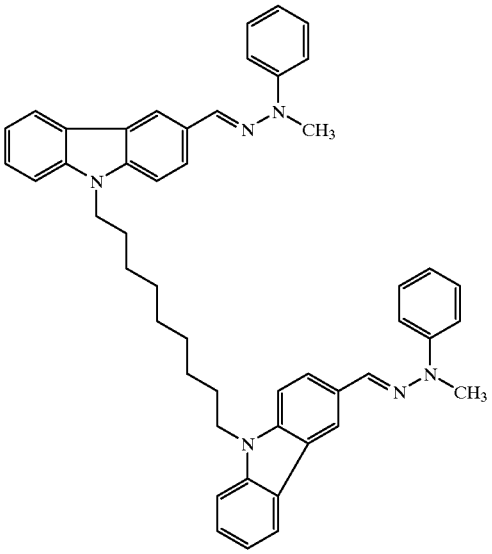
(16)
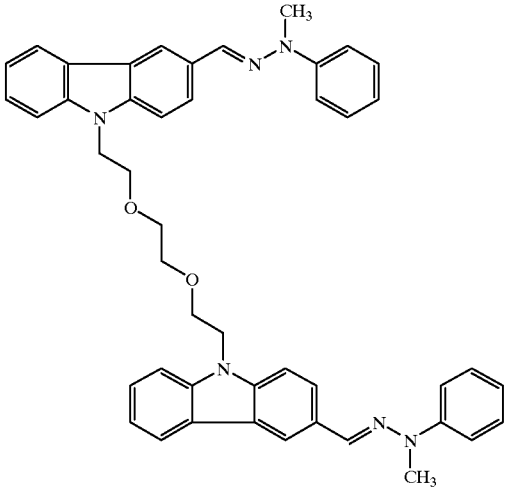

-continued (17)

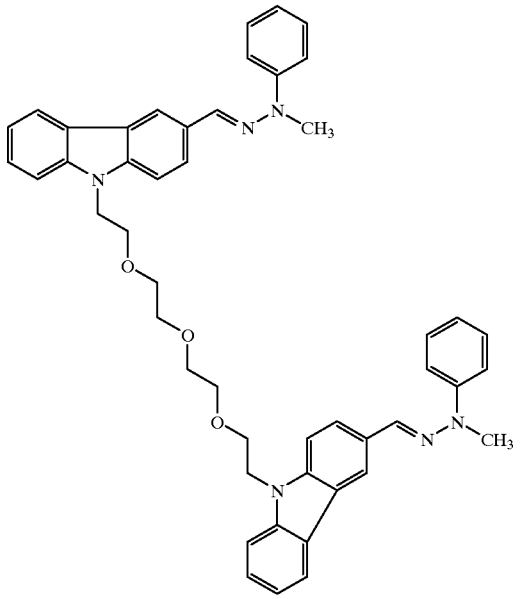

The invention also features the charge transport compounds themselves.

In a second aspect, the invention features an electrophotographic imaging apparatus that includes (a) a plurality of support rollers, at least one having a diameter no greater than about 40 mm; and (b) the above-described organic photoreceptor in the form of a flexible belt threaded around the support rollers. The apparatus preferably further includes a liquid toner dispenser.

In a third aspect, the invention features an electrophotographic imaging process that includes (a) applying an electrical charge to a surface of the above-described organic photoreceptor; (b) imagewise exposing the surface of the organic photoreceptor to radiation to dissipate charge in selected areas and thereby form a pattern of charged and uncharged areas on the surface; (d) contacting the surface with a liquid toner that includes a dispersion of colorant particles in an organic liquid to create a toned image; and (e) transferring the toned image to a substrate.

In a preferred embodiment, the organic photoreceptor is in,the form of a flexible belt, e.g., a flexible belt threaded around a plurality of support rollers, at least one of which has a diameter no greater than about 40 mm.

In a fourth aspect, the invention features a method of making an organo-photoreceptor that includes laminating together (a) a first substrate comprising a charge transport layer that includes a charge transport compound and a polymeric binder and (b) a second substrate comprising a charge generating layer that includes a charge generating compound and a polymeric binder to form an organo-photoreceptor in which the charge transport layer and the charge generating layer are in facing relationship with each other. One of the substrates is an electro-conductive substrate.

The invention provides organic photoreceptors featuring a combination of good mechanical and electrostatic properties. These photoreceptors can be used successfully with liquid toners to produce high quality images even when subjected to significant mechanical stresses encountered when the photoreceptor is in the form of a flexible belt threaded around a plurality of small diameter rollers. The high quality of the images is maintained after repeated cycling.

Other features and advantages of the invention will be apparent from the following description of the preferred embodiments thereof, and from the claims.

DETAILED DESCRIPTION

The invention features organic photoreceptors that include charge transport compounds having the formulae set forth in the Summary of the Invention, above. The charge transport compounds and arylhydrazones of 3-formyl carbazoles. For a given photoreceptor, the charge transport compound and amount thereof are selected such that when dissolved or dispersed in a polymeric binder, the resulting mixture exhibits a glass transition temperature of about 80° C. or higher, more preferably about 90° C. or higher, as measured by differential scanning calorimetry using a heating rate of 10° C./minute.

The charge transport compounds according to Formula (1) may be prepared using adaptations of known synthetic techniques. For example, in the case of compounds (2), (3), (5), (6), (8), (9), (13), (14), and (15) where X is a methylene group and n is 2, the preferred synthesis involves reacting the appropriate α,ω-dibromoalkane with two equivalents of carbazole in the presence of base to form the dimeric carbazole, followed by introducing the arylhydrazone substituents using standard synthetic methods. An alternative synthesis involves N-alkylation of a carbazole derivative by a bromoalkane equipped with a reactive group, followed by introduction of an arylhydrazone substituent using standard synthetic methods, and finally by oligomerization via the reactive groups. The latter synthesis is preferred in the case of compounds such as compounds (4) and (12) where X is a ring. Examples of suitable reactive groups include 1-alkynes, which may be trimerized to form a phenyl ring, and 1-alkenes, which may be reacted with a polyfunctional linking group such as tetramethylcyclotetrasiloxane (see compound (4)).

The organic photoreceptor may be in the form of a plate, drum, or belt, with flexible belts being preferred. The photoreceptor may include a conductive substrate and a photoconductive element in the form of a single layer that includes both the charge transport compound and charge generating compound in a polymeric binder. Preferably, however, the photoreceptor includes a conductive substrate and a photoconductive element that is a bilayer construction featuring a charge generating layer and a separate charge transport layer. The charge generating layer may be located intermediate the conductive substrate and the charge transport layer. Alternatively, the photoconductive element may be an inverted construction in which the charge transport layer is intermediate the conductive substrate and the charge generating layer.

The charge generating compound is a material which is capable of absorbing light to generate charge carriers, such as a dyestuff or pigment. Examples of suitable compounds are well-known and include metal-free phthalocyanine pigments (e.g., Progen 1 x-form metal-free phthalocyanine pigment from Zeneca, Inc.).

The binder is capable of dispersing or dissolving the charge transport compound (in the case of the charge transport layer) and the charge generating compound (in the case of the charge generating layer). Examples of suitable binders for both the charge generating layer and charge transport layer include styrenebutadiene copolymers, modified acrylic polymers, vinyl acetate polymers, styrene-alkyd resins, soya-alkyl resins, polyvinylchloride, polyvinylidene chloride, acrylonitrile, polycarbonate, polyacrylic and methacrylic esters, polystyrene, polyesters, and combinations thereof. Polycarbonate binders are particularly preferred. Examples of suitable polycarbonate binders include aryl polycarbonates such as poly(4,4-dihydroxy-diphenyl-1,1-cyclohexane) ("Polycarbonate Z") and poly(Bisphenol A carbonate-co-4,4'(3,3,5-trimethyl cyclohexylidene) diphenol.

The photoreceptor may include additional layers as well. Such layers are well-known and include, for example, barrier layers and release layers. Examples of suitable barrier layers include crosslinkable siloxanol-colloidal silica hybrids (as disclosed, e.g., in U.S. Pat. Nos. 4,439,509; 4,606,934; 4,595,602; and 4,923,775); a coating formed from a dispersion of hydroxylated silsesquioxane and colloidal silica in an alcohol medium (as disclosed, e.g., in U.S. Pat. No. 4,565,760); or a polymer resulting from a mixture of polyvinyl alcohol with methyl vinyl ether/maleic anhydride copolymer. A preferred barrier layer is polyvinyl butyral crosslinked with 2,5-furandione polymer with methoxyethene and containing about 30% silica. Examples of suitable release layers include fluorinated polymers, siloxane polymers, silanes, polyethylene, and polypropylene. with crosslinked silicone polymers being preferred.

The charge transport compounds, and photoreceptors including these compounds, are suitable for use in an imaging process with either dry or liquid toner development. Liquid toner development is generally preferred because it offers the advantages of providing higher resolution images and requiring lower energy for image fixing compared to dry toners. Examples of useful liquid toners arc well-known. They typically include a colorant, a resin binder, a charge director, and a carrier liquid. A preferred resin to pigment ratio is 2:1 to 10:1, more preferably 4:1 to 8:1. Typically, the colorant, resin, and the charge director form the toner particles.

Organic photoreceptors according to the invention are particularly useful in a compact imaging apparatus where the photoreceptor is wound around several small diameter rollers (i.e., having diameters no greater than about 40 mm). A number of apparatus designs may be employed, including for example, the apparatus designs disclosed in U.S. Pat. Nos. 5,650,253 and 5,659,851, both of which are hereby incorporated by reference.

The invention will now be described further by way of the following examples.

EXAMPLES

A. Synthesis

Charge transport compounds were synthesized as follows. The number associated with each compound refers to the number of the chemical formula set forth in the Summary of the Invention, above.

Compound (2)

Carbazole (120 g, 0.72 mol), dibromodecane (100 g, 0.33 mol), and benzyltriethyl ammonium chloride (12 g) were dissolved in tetrahydrofuran (400 mL) and a concentrated solution of sodium hydroxide (120 g) in water (120 mL) was added. The mixture was heated at reflux with strong mechanical stirring for 4 hours, then cooled to room temperature and poured into an excess of water. The solid that precipitated was filtered off and the tetrahydrofuran layer was dried ($MgSO_4$) and concentrated to dryness. The combined organic solids were recrystallized from tetrahydrofuran/water and dried in a vacuum oven to yield 116.5 g (69%) of 1,10-bis(9-carbazoyl)decane as an off-white solid, m.p.=130° C.

Dimethylformamide (200 mL) was stirred and cooled in an ice bath while phosphorus oxychloride (70 mL, 115 g, 0.75 mol) was gradually added. 1,10-bis(9-carbazoyl) decane (100 g, 0.22 mol) was introduced and the resulting mixture was heated on a steam bath with stirring for 1.5 hours. A viscous, dark brown liquid was generated from which a yellow solid precipitated upon cooling. This entire mixture was added to water (400 mL) and the crude product was filtered off at the pump, washed with water (200 mL), and then with a little ethanol. Recrystallization from tetrahydrofuran/water afforded 1,1 0-bis(3-formyl-9-carbazolyl)decane as light brown crystals (92.3 g, 83%), m.p.=122° C.

1,10-Bis(3-formyl-9-carbazolyl)decane (34 g, 64 mmol) and N-methyl-N-phenyl-hydrazine (15.5 mL, 16.1 g, 130 mmol, 2 equiv.) were combined in tetrahydrofuran (600 mL) and heated at reflux with stirring for 2 hours. Upon cooling to room temperature the volume of the solvent was reduced to about 300 mL and ethanol was added until the solution became cloudy. The mixture was heated on a steam bath until it was clear once more and was then left overnight. A brown solid (41 g) was collected and recrystallized further three times from tetrahydrofuran/ethanol along with decolorizing charcoal and then dried in a vacuum oven. Compound (2) was collected as a pale yellow solid (33 g, 70%) m.p.=164° C.

Compound (3)

1,10-Bis(3-formyl-9-carbazolyl)decane (2.04 g, 3.9 mmol), prepared as described above in connection with the synthesis of Compound (2), was dissolved in tetrahydrofuran (50 mL) and a solution of N,N-diphenylhydrazine hydrochloride (1.77 g, 8 mmol, 2.1 equiv.) in ethanol (10 mL) was added. An aqueous solution of potassium carbonate was then introduced (1.13 g in 6 mL of water) and the mixture was heated at reflux in the dark for 3 hours. Upon cooling, the phases were separated by the addition of a small quantity of diethyl ether and the organic layer was washed with 2 M HCl, then water and was subsequently dried ($MgSO_4$) and concentrated in vacuo. Recrystallization from tetrahydrofuran/ethanol with decolorizing charcoal (twice) gave 2.63 g (79%) of Compound (3) as a light brown solid, m.p.=185° C.).

Compound (4)

Carbazole (30.1 g, 0.18 mol), 5-bromo-1-pentene (25.5 g, 0.17 mol), and triethylammonium chloride (6 g, 0.026 mol) were combined in tetrahydrofuran (200 mL), and a solution of sodium hydroxide (14 g, 0.35 mol) in water (60 mL) was added. The mixture was heated at reflux with stirring for 6 hours, then cooled to room temperature and left overnight. The aqueous layer was separated and the organic phase was concentrated to dryness. The crude product was redissolved in diethyl ether (100 mL) and washed with water (2×50 mL), dried ($Na_2SO_4$,) and then concentrated in vacuo. Recrystallization from methanol afforded N-pentenyl-carbazole as cream-colored needles (27.6 g, 65%), m.p.=47° C.

Phosphorus oxychloride (9.1 g, 60mmol) was added to dimethylformamide (17 mL) at 0° C. with strong stirring over 15 minutes. Upon complete addition, the orange solution was stirred at 0° C. for a further 10 minutes. N-pentenyl-carbazole (10.5 g, 45 mmol) was gradually added to the iminium salt and the mixture was heated at 100° C. for 1.5 hours, then cooled to room temperature and added to ice. The ice slurry was adjusted to a pH of 6 with saturated sodium acetate solution and the crude product was extracted with dichloromethane (2×50 mL), dried ($Na_2SO_4$), and concentrated. Traces of dimethylformamide were removed under high vacuum to give 9.6 g of 3-formyl-N-pentenyl-carbazole as a brown oil. The material was used at this level of purity in the next step of the synthesis.

A mixture of 3-formyl-N-pentenyl-carbazole (4 g, 17 mmol) and N-methyl-N-phenyl-hydrazine (2.2 g, 18 mmol) in tetrahydrofuran (20 mL) was refluxed for 16 hours with stirring. Upon removal of the solvent, the crude material was triturated with petroleum ether (40–60° C.) and the solid was filtered off at the pump. Recrystallization (twice from tetrahydrofuran/ethanol) gave 3.5 g (61%) of N-pentenyl-carbazol-3-aldehyde-N'-methyl-N'-phenyl-hydrazone (m.p.=116° C.).

N-pentenyl-carbazole-3-aldehyde-N'-methyl-N'-phenyl-hydrazone (1.4 g, 4.1 mmol) and 1,3,5,7-tetramethylcyclotetrasiloxane (0.24 g, 1 mmol) were combined in anhydrous tetrahydrofuran (10 mL) and flushed with nitrogen. Platinum-divinyltetramethyldisiloxane complex in xylene (2 drops from a Pasteur pipette) was introduced and the mixture was subsequently heated at 65° C. for 1 hour. The crude material was chromatographed on a column of silica (1:1 petroleum ether (40–60° C.)/diethyl ether as the eluent). This technique appeared to cause degradation of the product. Nevertheless, 250 mg (ca. 15%) of the pure tetramer (Compound (4)) was isolated.

Compound (5)

Reaction of the anion of carbazole with 1,9-dibromononane proceeded in 77% yield via the method described above for the preparation of 1,10-bis(9-carbazolyl)decane used in the synthesis of Compound (2). Formylation (86%) followed by hydrazone formation to give Compound (5) (47%, m.p.=120–123° C.).

Compound (6)

A solution of carbazole (22 g, 0.13 mol) in dry tetrahydrofuran (200 mL) was added over 40 minutes to a suspension of sodium hydride (60% in mineral oil, 5.9 g, 0.15 mol) in tetrahydrofuran (75 mL) under a nitrogen atmosphere. After half an hour, a solution of 1,12-dibromododecane (20 g, 0.06 mol) in dry tetrahydrofuran (80 mL) was added and the mixture was refluxed under nitrogen with magnetic stirring for 3 hours. Once cooled to room temperature, the mixture was diluted with diethyl ether (100 mL), washed with water (2×50 mL), dried ($MgSO_4$) and concentrated to give a viscous oil. This was triturated with 40–60° C. petroleum ether and the solid was filtered off and dried in a vacuum oven to give 24.8 g (83%) of 1,12-bis(9-carbazoyl) dodecane (m.p.=98–99° C.).

Dimethylformamide (30 mL) was stirred and cooled in an ice bath while phosphorus oxychloride (8.3 mL, 13.7 g, 90 mmol) was added gradually. 1,12-bis(9-carbazolyl) dodecane (14.6 g, 29 mmol) was introduced and the resulting mixture was heated on a steam bath with stirring for 2 hours. Upon cooling, the resulting viscous, dark brown liquid was added to a saturated solution of sodium acetate. The aqueous solution was decanted off and the organic material was dissolved in dichloromethane (250 mL), washed with a small amount of brine, dried ($MgSO_4$), and concentrated in vacuo. The crude product was recrystallized from toluene/tetrahydrofuran and then dried overnight in a vacuum oven at 60° C. 1,12-bis(3-formylcarbazolyl) dodecane was isolated as light brown crystals (8.8 g, 55%), m.p.=149° C.

1,12-Bis(3-formylcarbazolyl)dodecane (4.7 g, 8.5 mmol) and N-methyl-N-phenyl hydrazine (2.3 g, 19 mmol, 2.2 equiv.) were combined in tetrahydrofuran (100 mL) and heated at reflux with stirring for 3.5 hours. Upon cooling to room temperature, the solvent was removed and the crude product was washed with water and then ethanol. Recrystallization from toluene (×2) and tetrahydrofuran/ethanol (once) gave Compound (6) as a pale cream solid (4 g, 62%), m.p.=113–115° C.

Compound (7)

A solution of N-(hydroxyethyl)carbazole (10.55 g) and triethyl amine (10 mL) in dichloromethane (100 mL) was cooled to 0° C. Adipoyl chloride (3.6 mL) was added dropwise with stirring. The solution was allowed to warm to room temperature and stirring continued for a further 2 hours. After washing with water (2×100 mL), the solvent was evaporated to give the crude solid product. Recrystallization from ethyl acetate/petroleum ether (1:2) afforded bis(carbazolyl)ethyl adipoate as a white solid product (5.6 g, 42%)).

A solution of 5.6 g of bis(carbazolyl)ethyl adipoate in dimethylformamide (10 mL) was added at 0° C. to Vilsmier reagent formed from phosphorus oxychloride (4 mL) and dimethylformamide (20 mL). The mixture was heated to 80° C. for 2 hours and then poured onto ice and potassium acetate. The crude solid product was collected by filtration and recrystallized from petroleum ether to give bis(3-formylcarbazolyl)ethyl adipoate (2.6 g, 42%).

Bis(3-formylcarbazolyl)ethyl adipoate (2.6 g) was refluxed with N-phenyl-N-methyl hydrazine (1.1 mL) in tetrahydrofuran (40 mL) for 1 hour. The solution was poured into ethanol/water (500 mL 1:1). The crude sticky product was collected by decanting the liquid phase, dried, and purified by flash chromatography (silica, ethyl acetate/petroleum ether 2:1). The solid product was further purified by recrystallization from petroleum ether/ethyl acetate to give 1.1 g (31%) of Compound (7) (m.p.=116° C.).

Compound (8)

1,12-Bis(3-formylcarbozolyl)dodecane (8.8 g, 16 mmol, prepared as described in the procedure used to prepare Compound (6)) was dissolved in tetrahydrofuran (150 mL) and a solution of N,N-diphenylhydrazine hydrochloride (7.6 g, 34 mmol, 2.1 equiv.) in ethanol (50 mL) was added. A solution of sodium acetate was then introduced (2.8 g in 10 mL of ethanol and 3 mL of water), and the mixture was heated at reflux in the dark for 4.5 hours under nitrogen. Upon cooling, the phases were separated by the addition of a small quantity of diethyl ether. The organic layer was washed with 2 M HCl, then water and was subsequently dried ($MgSO_4$) and concentrated in vacuo. Recrystallization from toluene with decolorizing charcoal (×2) gave 7.2 g (51%) of Compound (8) as a light brown solid (m.p.=169° C.).

Compound (9)

Phenyl hydrazine (44 mL) was added dropwise to a stirred suspension of sodium amide (19 g) in dry tetrahydrofuran (350 mL) while maintaining a temperature below 12° C. The mixture was allowed to warm to room temperature and stirred for 16 hours under a gentle stream of nitrogen. Cyclohexyl iodide (100 g) was added dropwise over 2 hours with cooling to maintain a temperature of less than 15° C. After leaving the mixture to stand for 24 hours, water (300 mL) was added, followed by ether (300 mL). The organic layer and an ether extract of the aqueous layer were combined, washed with water, dried over $MgSO_4$ and evaporated to give the crude product. Unreacted phenyl hydrazine was removed from the product by distillation (0.2 mm, 52–96° C.). The residue from the distillation was poured into a solution of concentrated hydrochloric acid (10 mL) in ethanol (100 mL). The ethanol was removed by rotary evaporation and the product triturated with tetrahydrofuran. The white solid product was collected by filtration, washed with petroleum ether and dried to yield N-cyclohexyl-N-phenyl hydrazine hydrochloride (22 g, 22% yield).

N-cyclohexyl-N-phenyl hydrazine hydrochloride (5 g), 1,10-bis(3-formyl-9-carbazoyl)decane (5.5 g, prepared according to the procedure described in the preparation of Compound (2)), and potassium acetate (2.3 g) were refluxed together in toluene (100 mL) and ethanol (20 mL). The product was recrystallized from toluene to yield 6.8 g (75%) of Compound (9) (m.p.=145° C.).

Compound (10)

1,10-Bis(3-formyl-9-carbazoyl)decane (13 g, prepared according to the procedure described in the preparation of Compound (2)) and N-methyl-N-phenyl hydrazine (4 g) were refluxed together in tetrahydrofuran (200 mL) and ethanol (250 mL). The solid product was collected by filtration and found to be a mixture of the desired mixed aldehyde hydrazone and Compound (2). Recrystallization from toluene afforded Compound (2). Evaporation of the filtrate yielded crude 1-(3-formyl-9-carbazolyl)-10-(3-[N-methyl-N-phenyl hydrazonyl]-9-carbazolyl)decane (7.2 g).

The crude material was refluxed with N,N-diphenylhydrazine hydrochloride (2.6 g) and potassium acetate (1.2 g) in tetrahydrofuran (200 mL) for 2 hours. The product was collected by filtration and recrystallized four times from toluene, each time keeping the filtrate; evaporating; and recrystallizing. The final filtrate was evaporated to give 2.5 g of Compound (10) as a glass (m.p.=76–78° C.).

Compound (11)

A solution of sodium azide (6.5 g) in water (20 mL) was added to iminodibenzyl-5-carbonyl chloride (25 g) in ethanol (200 mL) at 60° C. After refluxing for 3 hours, the ethanol was removed by evaporation. The product was taken up in ether, washed twice with water, dried over $MgSO_4$ and evaporated to yield 23 g (91%) of iminodibenzyl-5-carbonyl azide.

Iminodibenzyl-5-carbonyl azide (23 g) was refluxed in tertbutanol (150 mL) for two weeks. A solid precipitated and was collected by filtration and washed with ethanol. The solid was dissolved in hot toluene (200 mL), filtered and evaporated. Neither purification by flash chromatography (silica, petrol) yielded N-tertbutyloxycarbonylamino iminodibenzyl as a white solid. Yield: 9.1 g (34%).

N-tert-butyloxycarbonylamino iminodibenzyl was refluxed in methanol (250 mL) containing conc. hydrochloric acid (2.5 mL) for 5 hours. The solution was evaporated to give a dark sticky solid. This was refluxed for 2 hours in tetrahydrofuran (250 mL) with 1,10-bis(3-formyl-9-carbazoyl)decane (5 g, prepared according to the procedure described in the preparation of Compound (2)) and potassium acetate (5 g). The solution was poured into water (1 L) and the solid product collected by decanting the aqueous phase. The product was purified by flash chromatography (silica, petroleum ether/dichloromethane 1:1) to yield 2.1 g of Compound (11) (m.p.=120–123° C.).

Compound (12)

A solution of carbazole (3.7 g, 22 mmol) in dry tetrahydrofuran (50 mL) was gradually added to a stirred suspension of sodium hydride (60% in mineral oil, 0.9 g, 23 mmol) also in dry tetrahydrofuran (20 mL). The mixture was stirred at 40° C. for 1 hour under nitrogen, cooled to room temperature, and then added to a solution of 6-tosyloxyhexyne (5.1 g, 20 mmol) in dry tetrahydrofuran (20 mL). After refluxing for 5 hours under nitrogen, the reaction mixture was cooled to ambient temperature and the solid was removed by filtration through Celite. Water was added to the filtrate, followed by some diethyl ether which separated the organic and aqueous layers. The organic phase was dried ($MgSO_4$) and evaporated to dryness. Recrystallization from methanol afforded 3.2 g (62%) of 6-(9'-carbazolyl)hex-1-yne (m.p.=89° C.).

Phosphorus oxychloride (7 g, 46 mmol) was gradually added to ice-cold dimethylformamide (15 mL) over 30 minutes, after which time the mixture was stirred at room temperature for a further 30 minutes. 6-(9'-Carbazolyl)hex-1-yne (9.2 g, 35 mmol) was added and the mixture was heated at 100° C. for 1 hour. Upon cooling, the viscous oil was poured into an ice/sodium acetate slurry and the organic material was extracted with dichloromethane (200 mL), washed with water (100 mL), dried ($MgSO_4$), and evaporated to dryness. Recrystallization from methanol gave 6-(9'-[3'-formylcarbazolyl])hex-1-yne (6.5 g, 64% yield).

6-(9'-[3'-Formylcarbazolyl])hex-1-yne (3.5 12 mmol) in tetrahydrofuran (35 mL) was mixed with N,N-diphenylhydrazine hydrochloride (2.9 g, 13 mmol, 1.1 equiv.) in ethanol (20 mL). An aqueous solution of potassium carbonate (1.8 g, 13 mmol in 5 mL of water) was added and the mixture was subsequently heated at reflux for 6 hours in the dark. After cooling, diethyl ether and additional water were added. The phases were separated and the organic layer was evaporated to dryness and then re-dissolved in dichloromethane (40 mL), washed with water, 2 M HCl, saturated sodium hydrogen carbonate, and then water. The solution was dried ($MgSO_4$) and concentrated in vacuo to furnish a brown oil. Chromatography on silica (dichloromethane/petroleum ether (40–60° C.); 1:1 v/v) and subsequent recrystallization from ethanol afforded 3.2 g (60%) of 6-(9'-[3'-N,N-diphenylhydrazonylcarbazolyl])hex-1-yne (m.p.=46–47° C.).

6-(9'-[3'-N,N-diphenylhydrazonylcarbazolyl])hex-1-yne (3.1 g, 7 mmol) was dissolved in dry, hot octane (50 mL) under nitrogen. Cyclopentadienylcobalt dicarbonyl (10% w/v in dry octane, 1.8 mL, 0.18 g, 1 mmol) was added, causing the solution to darken. After 2 days reflux the mixture was cooled to room temperature and the product was found to be coated on the surface of the glass flask. The octane solution was decanted off and the solid was dissolved in dichloromethane. Chromatography on silica (dichloromethane as eluent) gave 1 g (33% yield) m.p.=135° C.) of the pure Compound (12).

Compound (13)

1,8-Bis(3-formylcarbazolyl)octane (m.p.=162° C.) was synthesized via an analogous procedure to that employed in the preparation of 1,10-bis(3-formyl-9-carbazolyl)decane, as described in the synthesis of Compound (2). Formylation was achieved in a 76% yield. Compound (13) was made via a similar procedure for that used for Compound (3). Recrystallization from toluene (×3) yielded Compound (13) as an off-white solid (m.p.=185° C.).

Compound (14)

1,11-Bis(3-formylcarbazolyl)undecane (m.p.=94–95° C.) was prepared in an 80% yield using an analogous procedure to that employed for 1,10-bis(3-formyl-9-carbazolyl) decane, as described in the synthesis of Compound (2). Formylation proceeded in 56% yield. Compound (14) was made via a similar procedure for that used for Compound (3). The synthesis produced Compound (14) in a 64% yield (m.p.=114–117° C.).

Compound (15)

1,9-Bis(3-formylcarbazolyl)nonane was made in a manner similar to that taught by Zhang, Wada, and Sasabe, *J. Polym. Sci. Part A: Polym. Chem.* 1996, 34, 2289. This dialdehyde (24.05 g, 46.6 mmol), and N-methyl-N-phenylhydrazine (12.2 g, 100 mmol) were allowed to react to yield 31.60 g (94%) of compound (15) as a slightly yellow powder. $^1$H-NMR and IR spectra agreed with the desired structure. The material was recrystallized from toluene three times prior to use.

Compound (16)

1,2-Bis(2-iodoethoxy)ethane (49.96 g, 135 mmol), carbazole (48.54 g, 290 mmol), benzyltriethyl-ammonium chloride (4.80 g), and sodium hydroxide were mixed in toluene (200 mL) and water (50 mL) and allowed to react as in step 1 of the preparation of compound (17), below. After reaction was complete, the mixture was left stirring at room temperature overnight. A precipitate formed. The precipitate was collected by filtration and washed with toluene (30 mL), ethanol (30 mL), and water (1 L). Vacuum evaporation of solvents left 46.75 g of colorless powder, m.p.=125–128° C. IR and $^1$H-NMR spectra were consistent with the desired product.

The carbazole dimer (7.03 g, 15.7 mmol) was converted to a dialdehyde by reaction with $POCl_3$ (4.5 mL, 45 mmol) in DMF (15 mL) in a manner similar to that used in step 2 of the preparation of compound (17), below. The reaction was quenched in water (40 mL), sodium hydroxide (6.5 g) and ice. This was extracted with dichloromethane (200 mL). The organic phase was washed with water, dried ($MgSO_4$), and solvents were removed by vacuum evaporation. The resulting 6.5 g of solid was combined with 4 g of similar material from another reaction and recrystallized from 1:1 toluene/tetrahydrofuran to leave 95 g of a yellow solid. $^1$H-NMR and IR spectra were consistent with the desired product.

Dialdehyde (6.54 g, 13.0 mmol) and toluene (40 mL) were combined in 250 mL flask equipped with a reflux condenser, drying tube, and magnetic stirrer. The mixture was heated with stirring until the solid dissolved. The heat was removed, and concentrated HCl (5 drops) was added, followed by N-methyl-N-phenyl hydrazine (3.4 g, 28 mmol) in ethanol (6 mL). After boiling subsided, the heat was restored and the solution was refluxed for 4.5 hours. The solution was stirred at room temperature overnight, during which a precipitate formed. The solid was collected by filtration and rinsed with toluene and ethanol. Evaporation of solvents left 7.26 g of a light yellow solid with IR and $^1$H-NMR spectra consistent to the desired product. To test the electrostatics, a sample was purified by column chromatography over silica gel 60 (EM Science) using 25% to 35% ethyl acetate in hexane as eluents. This gave a light yellow powder, m.p.=152–155° C. $^1$H-NMR and IR spectra were consistent with the desired product.

Compound (17)

This material was prepared via a three step synthesis. First the carbazole dimer was prepared. This was converted to the dialdehyde, which was reacted with two equivalents of 1-methyl-1-phenylhydrazine to obtain the final product.

To a 1-Liter 3-neck round bottom flask equipped with mechanical stirrer and reflux condenser were added carbazole (65.4 g, 0.39 mol), benzyltriethylammonium chloride (6.19 g, 0.027 mol), tetraethylene glycol di-p-tosylate (0.18 mol) and 250 mL of toluene. The mixture was stirred with heating until all solid entered solution, then a solution of sodium hydroxide (65.18 g, 1.63 mol) in 80 mL of water was added slowly to the mixture. After the addition of the sodium hydroxide solution was complete, the mixture was refluxed for 4 hours, then stirred at room temperature overnight. The organic phase was separated and washed repeatedly with water until the pH of the washing was neutral. The organic phase was then dried over $MgSO_4$. Filtration to remove drying agent and solvent evaporation yielded a highly viscous liquid (85% yield). $^1$H-NMR and IR spectra are in accord with the proposed dimeric structure.

To a 1-Liter 3-neck round bottom flask equipped with reflux condenser, mechanical stirrer and dropping funnel were added 69 g (0.17 mol ) of the dimer prepared above and 200 mL DMF. The flask was stirred at room temperature for 10 minutes then placed in ice bath and calcium sulfate drying tubes were attached to both the reflux condenser and dropping funnel. 55 mL of $POCl_3$ (0.59 mol) was added slowly to the solution over a 30 minute period. After the addition of $POCl_3$ was complete, the flask was heated in boiling water bath for two hours. The solution was added very slowly to a 2-liter beaker containing a solution of 144 g sodium acetate (1.75 mol) in 300 mL water. The beaker was stirred mechanically and cooled in an ice bath. After the addition of the solution was complete, more water was added to make the total volume 2 liters. Stirring at 0 C. was continued for an additional 2 hours. The product was obtained as gummy material from the large excess of water. The water was decanted from the residue. The residue was extracted with toluene, washed several times with water, dried over ($MgSO_4$), and filtered. Solvents were removed by vacuum evaporation to give a highly viscous liquid in 77% yield. Upon leaving this liquid to stand at room temperature for couple of days it solidified. The IR and the II-NMR spectra are in complete accord with the proposed dialdehyde stricture. This dialdchyde was purified by dissolving it in toluene then adding a small amount of hexane to precipitate a very dark viscous material which sticks on the surface of the flask. The solution was decanted from the viscous impurity. More hexane was added to the solution, and a lighter colored viscous oil separated. When the solvents were evaporated, a viscous liquid was obtained. This solidified upon standing at room temperature for couple of days.

The dialdehyde prepared above (5.48 g, 0.01 mol) and N-methyl-N-phenyl hydrazine (2.69 g, 0.022 mol) were added to 70 mL toluene with a few drops of glacial acetic acid. The solution was refluxed for 5 hours. Solvents were removed by vacuum evaporation to obtain a viscous liquid. This was allowed to stand at room temperature for some time for it to solidify. This material is extremely soluble in most organic solvents except aliphatic hydrocarbons.

B. Photoreceptor Belts

Example 1

A photoreceptor belt incorporating a charge transport layer formed from Compound (2) and a binder was prepared as follows.

A dispersion was prepared by micronising Progen 1 x-form metal-free phthalocyanine pigment (Zeneca Inc.), S-Lec B Bx-5 polyvinylbutryal resin (Sekisui Chemical Co. Ltd.), and a 2:1 by volume solvent mixture of methyl ethyl ketone and toluene using a horizontal sand mill operating in recirculation mode for 8 hours. The pigment was dispersed into the resin at 9% solids. A 4% solids solution of the resulting dispersion was then die coated onto 3 mil (76 micrometer) thick aluminized polyethylene film (Melinex 442 polyester film from Dupont having a 1 ohm/square aluminum vapor coat) and dried to form a charge generating layer having a thickness of 0.3 micrometer.

A charge transport solution containing 50 wt. % Compound (2) in Polycarbonate Z binder (commercially available from Mitsubishi Gas Chemical under the designation "Lupilon Z-200" resin) was prepared by combining a solution of 1.25 g of Compound (2) in 8.0 g of tetrahydrofuran with 1.25 g of Polycarbonate Z in 2.50 g of toluene. The charge transport solution was then coated onto the charge generation layer and dried at 80° C. for 10 minutes to form a charge transport layer. The thickness of the charge transport layer was 8 micrometer±1 micrometer. The Tg of the charge transport layer was 89° C.

Example 2

A photoreceptor belt incorporating a charge transport layer formed from Compound (3) and a Polycarbonate Z binder was prepared according to the procedure of Example 1 except that Compound (3) was initially dissolved in 7.0 g of hot tetrahydrofuran. The charge transport layer contained 50 wt. % of Compound (3). The Tg of the charge transport layer was 97° C.

Example 3

A photoreceptor belt incorporating a charge transport layer formed from Compound (4) and a Polycarbonate Z binder was prepared according to the procedure of Example 1 except that Compound (4) was initially dissolved in 6.0 g of methyl ethyl ketone, rather than tetrahydrofuran. The charge transport layer contained 50 wt. % of Compound (4). The Tg of the charge transport layer was 86° C.

Example 4

A photoreceptor belt incorporating a charge transport layer formed from Compound (9) and a Polycarbonate Z binder was prepared according to the procedure of Example 1. The charge transport layer contained 50 wt. % of Compound (9). The Tg of the charge transport layer was 92° C.

Example 5

A photoreceptor belt incorporating a charge transport layer formed from Compound (12) and a Polycarbonate Z binder was prepared according to the procedure of Example 1. The charge transport layer contained 50 wt. % of Compound (12). The Tg of the charge transport layer was 136° C.

Example 6

A photoreceptor belt incorporating a charge transport layer formed from Compound (13) and a Polycarbonate Z binder was prepared according to the procedure of Example 1. The charge transport layer contained 50 wt. % of Compound (13). The Tg of the charge transport layer was 114° C.

Example 7

A photoreceptor belt incorporating a charge transport layer formed from Compound (14) and a Polycarbonate Z binder was prepared according to the procedure of Example 1. The charge transport layer contained 50 wt. % of Compound (14). The Tg of the charge transport layer was 106° C.

Comparative Example a

A photoreceptor belt incorporating a charge transport layer formed from N-ethyl-carbazolo-3-aldehyde-N-methyl-N-phenyl-hydrazone and a Polycarbonate Z binder was prepared according to the procedure of Example 3. The charge transport layer contained 50 wt. % of N-ethyl-carbazolo-3-aldehyde-N-methyl-N-phenyl-hydrazone. The Tg of the charge transport layer was 57° C. N-ethyl-carbazolo-3-aldehyde-N-methyl-N-phenyl-hydrazone has the structure shown below and was obtained from H. W. Sands Corp. Jupiter, Fla.

(a)

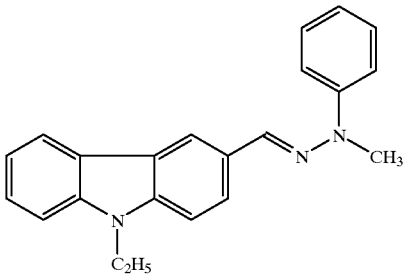

Comparative Example b

A photoreceptor belt incorporating a charge transport layer formed from N-ethyl-carbazolo-3-aldehyde-N-methyl-N-phenyl-hydrazone and a Polycarbonate Z binder was prepared according to the procedure of Example 3. The charge transport layer contained 50 wt. % of N-ethyl-carbazolo-3-aldehyde-N-methyl-N-phenyl-hydrazone. The Tg of the charge transport layer was 77° C. N-ethyl-carbazolo-3-aldehyde-N-methyl-N-phenyl-hydrazone has the structure shown below and was obtained from H. W. Sands Corp. Jupiter, Fla.

(b)

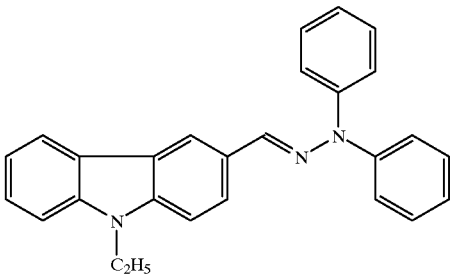

Comparative Example c

A photoreceptor belt incorporating a charge transport layer formed from a mixture of Compound (a) (0.625 g), Compound (b) (0.625 g), and a Polycarbonate Z binder was prepared according to the procedure of Example 3. The charge transport layer contained 25 wt. % of Compound (a) and 25 wt. % of Compound (b). The Tg of the charge transport layer was 63° C.

The above-described photoreceptor belts were tested to determine the extent of stress crazing that occurred when the belts were subjected to stress and contacted with Norpar 12 solvent, a solvent commercially available from Exxon Corp. and typically found in liquid toners. The test was conducted as follows.

The ends of a length of belt measuring 120 cm long by 21 cm wide were joined together using a piece of adhesive tape. The belt was then wrapped around a pair of spindles, each of which measured either 0.5 inch (12.7 mm) or 0.75 inch (18.8 mm) in diameter. The lower spindle was loaded with static weights to achieve a total load of 17 kg. A swab was soaked in Norpar 12 solvent, wrapped around the upper spindle, and held in place with a clip. After 10 minutes, the Norpar was wiped away and the belt examined by optical microscopy at 100× magnification to determine the extent of cracking and crazes.

The results of the stress test are reported in Table I, below. The following legends apply:

A: Very bad cracks, c.a. 3–5 micrometer wide, which have opened up in the presence of solvent.

B: Cracks measuring 1–3 micrometer wide.

C: Fine surface cracks measuring less than 1 micrometer wide.

NT: Not tested.

TABLE I

| Example | 0.5 inch (12.7 mm) spindle | 0.75 inch (18.8 mm) spindle |
|---|---|---|
| a | A | A |
| b | A | A |
| c | A | A |
| 1 | B | B |
| 2 | B | B |
| 3 | B | B |
| 4 | NT | NT |
| 5 | C | C |
| 6 | C | C |
| 7 | B | B |

The results shown in Table I demonstrate that photoreceptor belts incorporating charge transport compounds according to the invention exhibit improved resistance to stress crazing when wrapped around small diameter rollers and contacted with solvent.

C. Solubility Testing

Solubility testing of each individual charge transport compound was performed at room temperature using tetrahydrofuran as the solvent. Solubility results were reported as the percent solids of saturated solution. In general, it is desirable to maximize the solubility value.

D. Electrostatic Testing

Electrostatic testing was performed on a number of inverted dual layer organic photoreceptor samples. The charge transport layer of each sample included a charge transport compound having a —$(CH_2)_m$— linking group as defined above in Formula (1). The purpose of the testing was to examine the effect of the length of the linking group on electrostatic and solubility properties.

Electrostatic testing of compounds 2–14 was performed and recorded on a QEA PDT-2000 instrument at ambient temperature. Charge-up was performed at 8 kV. Discharge was performed by exposing the photoreceptor to a 780 nm-filtered tungsten light source down a fiber optic cable. Each sample was exposed to 2 microjoules/$cm^2$ of energy for 0.05 seconds; the total exposure intensity was 20 microwatts/$cm^2$. After charge-up, the acceptance voltage ($V_{acc}$) was measured in volts. This value was recorded as $V_{acc}$ after one cycle. Following this initial charge-up, a one second dark decay followed before the sample was discharged with the 0.05 second light pulse of 2 microjules/$cm^2$ at 780 nm, after which the residual voltage ($V_{res}$) was measured in volts. This value was recorded as $V_{res}$ after one cycle. $V_{acc}$ and $V_{res}$ were also measured after a total of 1000 cycles. In general, it is desirable to maximize $V_{acc}$ and to minimize $V_{res}$.

Electrostatic testing of compounds 15–17 was also performed and recorded following the same procedure used for compounds 2–14 except that charge-up was performed at 7 kV.

Samples for electrostatic testing were prepared either by lamination or by die coating.

Lamination

Inverted dual layer organo-photoreceptors were prepared incorporating compounds 2–14 as charge transport material. A charge transport solution containing 50 wt. % of a selected charge transport compound in Polycarbonate Z binder was prepared by combining a solution of 1.25 g of the charge transport compound in 8.0 g of tetrahydrofuran with 1.25 g of Polycarbonate Z in 2.50 g of toluene. The charge transport solution was then coated onto 3 mil (76 micrometer) thick aluminized polyethylene terephthalate film (Melinex 442 polyester film from Dupont having a 1 ohm/square aluminum vapor coat) and dried to form a charge transport layer having a thickness of 9 micrometers.

A dispersion was prepared by micronising 1.35 g of Progen 1 x-form metal-free phthalocyanine pigment (Zeneca Inc.), 1.35 g of S-Lee B Bx-5 polyvinylbutryal resin (Sekisui Chemical Co. Ltd.), 26 g of methyl ethyl ketone, and 13 g of toluene using a horizontal sand mill operating in recirculation mode for 8 hours. The resulting dispersion was then die coated onto unsubbed 2 mil (51 micrometer) thick polyethylene terephthalate (PET) film and dried at 80° C. for 10 minutes to form a charge generating layer having a thickness of 0.27 micrometer on the PET film.

The charge transport layer and the charge generating layer were laminated together at 140° C. using a Model 447 Matchprint™ Laminator (available from Imation Corp., Oakdale, Minn.). After lamination, the 2 mil PET film was peeled off the surface of the charge generation layer to form the inverted dual layer organophotoreceptor.

Inverted dual layer organophotoreceptors were also prepared incorporating compounds 15–17 as charge transport material. A charge transport solution containing 50 wt % of a selected charge transport compound in of Polycarbonate Z binder (commercially available from Mitsubishi Gas Chemical under the designation "Lupilon Z-200" resin) was prepared by combining a solution of 0.5 g of the charge transport compound in 4.0 g of tetrahydrofuran with 0.5 g of Polycarbonate Z. The charge transport solution was then coated onto 3 mil (76 micrometer) thick aluminized polyethylene terephthalate film (Melinex 442 polyester film from Dupont having a 1 ohm/square aluminum vapor coat) and dried to form a charge transport layer having a thickness of 9 micrometer±1 micrometer.

A dispersion was prepared by micronising 32.6 g of Progen 1 x-form metal free phthalocyanine pigment (Zeneca Inc.), 32.6 g of S-Lec B Bx-5 polyvinylbutryal resin (Sekisui Chemical Co. Ltd.), and 684.8 g of 2/1 (volume/volume) methyl ethyl ketone/toluene using a horizontal sand mill operating in recirculation mode for 8 hours. The resulting dispersion was slot coated onto unsubbed 2 mil (51 micrometer) thick polyethylene terephthalate (PET) film and dried to form a charge generating layer having a thickness of 0.27 micrometer on the PET film. Slot coating techniques are described by E. Cohen and E. Gutoff, *Modern Coating and Drying Technology*, VCH Publishers, Inc. New York, 1992. pp. 117–120.

The charge transport layer and the charge generating layer were laminated together as described above.

The results of the electrostatic and solubility testing are shown below in Table II. The "linker length" reflects the total number of units in Group X of the molecule as described in Formula (1).

The designation "MPH/DPH" is used to denote whether the charge transport compound includes methyl and phenyl groups ("MPH") bonded to the hydrazone moiety, or two phenyl groups ("DPH") bonded to the hydrazone moiety.

The designation "CTM" refers to the particular charge transport compound. The number associated with each compound refers to the number of the formula set forth in the Summary of the Invention, above.

The designation "NT" means not tested.

TABLE II

| CTM | Linker Length | MPH or DPH | $V_{acc}$ (1 cycle) | $V_{res}$ (1 cycle) | $V_{acc}$ (1000 cycles) | $V_{res}$ (1000 cycles) | Solubility % Solids |
|---|---|---|---|---|---|---|---|
| (13) | 8 | DPH | 411 | 84 | 506 | 100 | 14.1 |
| (5) | 9 | DPH | 496 | 147 | 502 | 170 | NT |
| (2) | 10 | MPH | 515 | 35 | 572 | 61 | 11.1 |
| (3) | 10 | DPH | 418 | 44 | 401 | 52 | 5.7 |
| (14) | 11 | DPH | 610 | 161 | 561 | 191 | 46.2 |
| (6) | 12 | MPH | 495 | 161 | 533 | 196 | 9.3 |
| (8) | 12 | DPH | 436 | 63 | 468 | 73 | 6.7 |
| (15) | 9 | MPH | 498 | 69 | 525 | 130 | 20 |
| (16) | 8 | MPH | 490 | 95 | 515 | 177 | NT |
| (17) | 11 | MPH | 693 | 466 | 687 | 664 | NT |

The data in Table II demonstrates that for a series of charge transport compounds differing only in the length of the linking group, compounds having an even number of linking units often perform better than compounds having an odd number of linking units (compare the performance of CTM compounds (13), (5), (3), (14), and (8), all of which are DPH-containing compounds). In addition, CTM compounds (2) and (3), both of which featured a total of 10 linking groups, and CTM compound (8) having a total of 12 linking units, exhibit a good best balance between electrostatic performance and solubility.

A large transport compound differing from compound (13) only it that it featured methyl and phenyl groups, rather than a pair of phenyl groups, bonded to the hydrazone moiety was also prepared. However, its solubility was too low to permit electrostatic testing under the test conditions employed. Charge transport compounds differing from the charge transport compounds set forth in Table II only in that they contained either a total of 4 or a total of 6 linking units were also prepared. However, with one exception, these compounds also were insufficiently soluble to permit electrostatic testing under the test conditions employed. The exception was a charge transport compound having 6 methylene groups and two phenyl groups bonded to the hydrazone moiety. Although this compound exhibited adequate solubility (15.0% solids of saturated solution), its electrostatic properties were not measured.

Die Coating

A charge transport solution containing 50 wt % of a selected charge transport compound in Polycarbonate Z binder (commercially available from Mitsubishi Gas Chemical under the designation "Lupilon Z-200" resin) was prepared by combining a solution of 13.0 g of the charge transport compound in 104.0 g of tetrahydrofuran with 13.0 g of Polycarbonate Z. The charge transport solution was then die coated onto 3 mil (76 micrometer) thick aluminized polyethylene terephthalate film (Melinex 442 polyester film from Dupont having a 1 ohm/square aluminum vapor coat) and dried to form a charge transport layer having a thickness of 8.75 micrometer. Die coating (also know as slot coating) techniques are described by E. Cohen and E. Gutoff, *Modern Coating and Drying Technology*, VCH Publishers, Inc. New York, 1992. pp. 117–120.

A dispersion was prepared by micronising 32.6 g of Progen 1 x-form metal free phthalocyanine pigment (Zeneca Inc.), 32.6 g of S-Lec B Bx-5 polyvinylbutryal resin (Sekisui Chemical Co. Ltd.), and 684.8 g of 2/1 (v/v) methyl ethyl ketone/toluene using a horizontal sand mill operating in recirculation mode for 8 hours. The resulting dispersion was die coated onto the charge transport layer and dried to form a charge generating layer having a thickness of 0.27 micrometer. This dual layer organic photoconductor was then overcoated with a barrier layer.

A barrier layer solution was prepared by combining 217.6 g of 6% S-Lec Bx-5 polyvinylbutryal resin (Sekisui Chemical Co. Ltd. in methanol), 1385.7 g isopropyl alcohol, 33.5 g Nalco 1057 colloidal silica, 33.1 5% Z-6040 silane (Dow Corning 50/50 in isopropyl alcohol/water), and 130.17 Gantrez AN-169 Polymer (ISP Technologies 50/50 in methanol/water). The barrier layer solution was then die coated onto the dual layer organic photoconductor and dried to form a barrier layer having thickness a 0.2 micrometer.

The results of the electrostatic testing are shown below in Table III.

TABLE III

| CTM | Linker Length | MPH or DPH | $V_{acc}$ (1 cycle) | $V_{res}$ (1 cycle) | $V_{acc}$ (1000 cycles) | $V_{res}$ (1000 cycles) |
|---|---|---|---|---|---|---|
| (2) | 10 | MPH | 553 | 56 | 584 | 88 |
| (15) | 9 | MPH | 652 | 79 | 629 | 79 |

Other embodiments are within the following claims.

What is claimed is:

1. A method of preparing an organophotoreceptor comprising laminating together (a) a first substrate comprising a charge transport layer that includes a charge transport compound and a polymeric binder and (b) a second substrate comprising a charge generating layer that includes a charge generating compound and a polymeric binder to form an organophotoreceptor in which said charge transport layer and said charge generating layer are in facing relationship with each other, wherein one of said substrates comprises an electroconductive substrate.

2. The method of claim 1, wherein the charge transport compound has the formula (1)

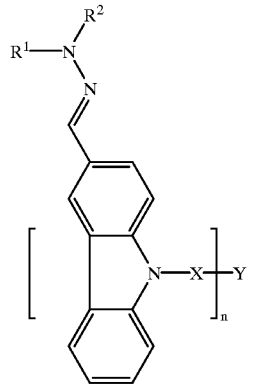

where n is an integer between 2 and 6, inclusive;

$R^1$ and $R^2$, independently, are an alkyl group, a cycloalkyl group, or an aryl group, or $R^1$ and $R^2$ combine with the nitrogen atom to form a ring;

Y is a bond, a carbon atom, a —$CR^3$ group, an aryl group, a cycloalkyl group, or a cyclosiloxyl group;

$R^3$ is hydrogen, an alkyl group, or an aryl group; and

X is a linking group having the formula —$(CH_2)_m$— where m is an integer between 4 and 10, inclusive, and one or more of the methylene groups is optionally replaced by an oxygen atom, a carbonyl group, or an ester group, wherein N is 2, 3, or 4;

(b) a charge generating compound; and (c) an electroconductive substrate.

3. The method of claim 1, wherein said organphotoreceptor is in the form of a flexible belt.

4. The method of claim 2, wherein n is 2, Y is a bond, and X has the formula —$(CH_2)_m$— where m is an integer between 4 and 7.

5. The method of claim 1, wherein said charge transport compound has the formula (2)
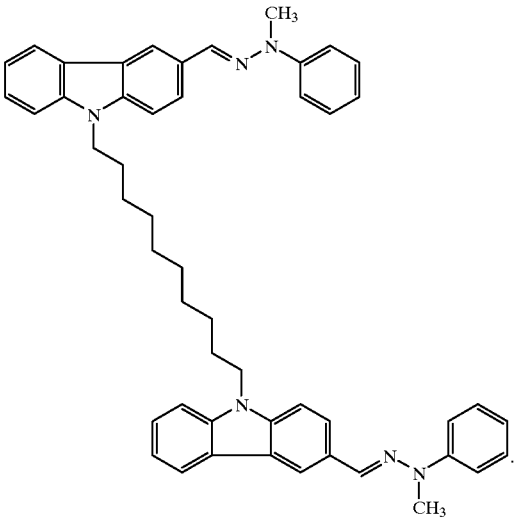
6. The method of claim 1, wherein said charge transport compound has the formula
(3)
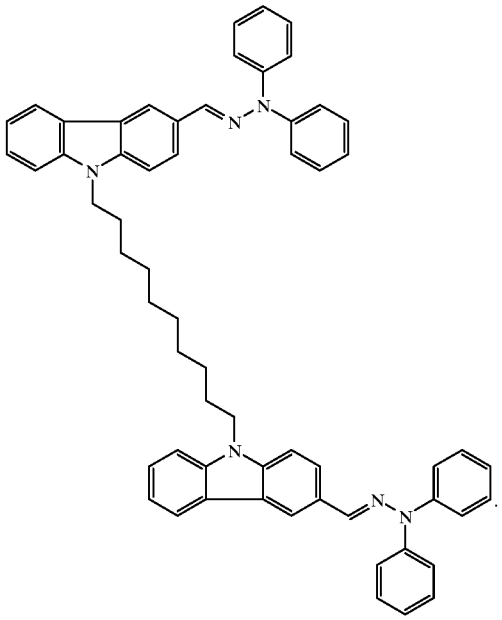
7. The method of claim 1, wherein said charge transport compound has the formula
(4)
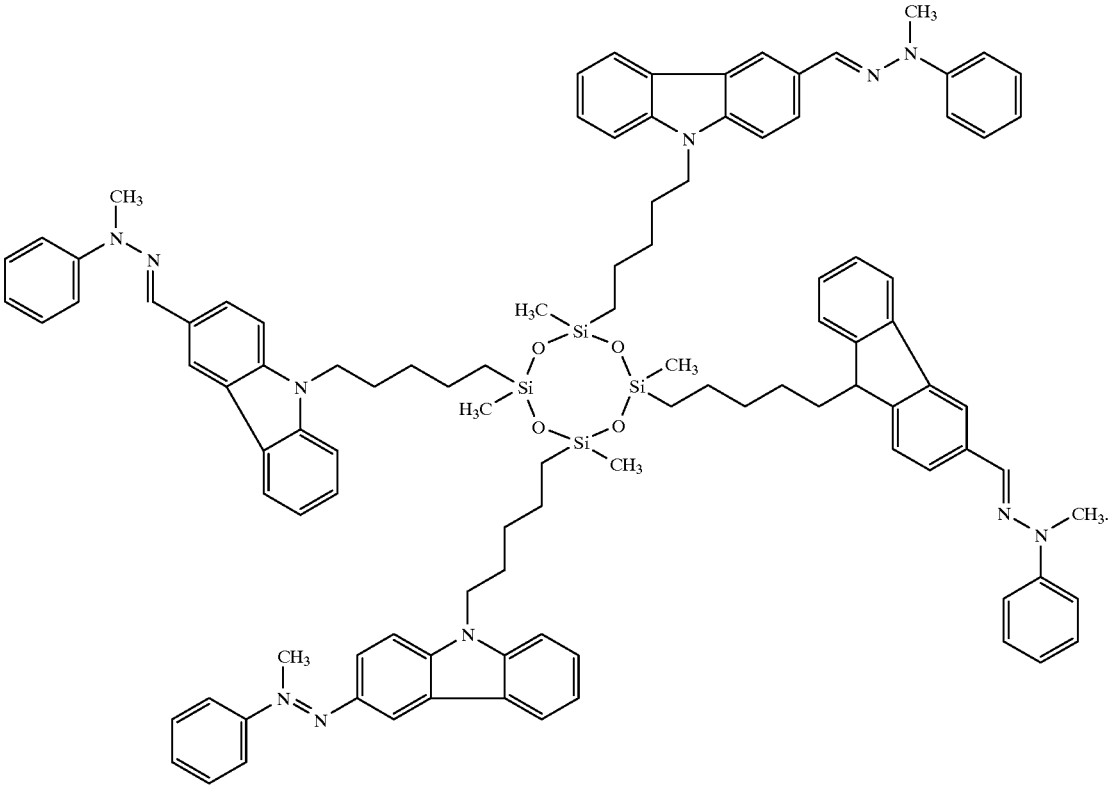

8. The method of claim 1, wherein said charge transport compound has the formula
(5)
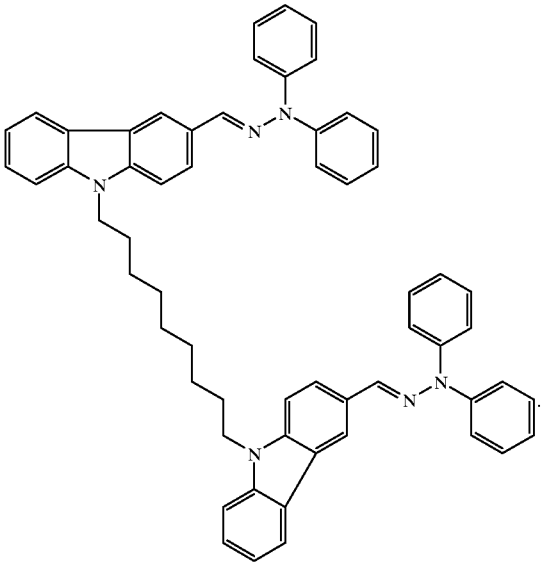
9. The method of claim 1, wherein said charge transport compound has the formula
(6)
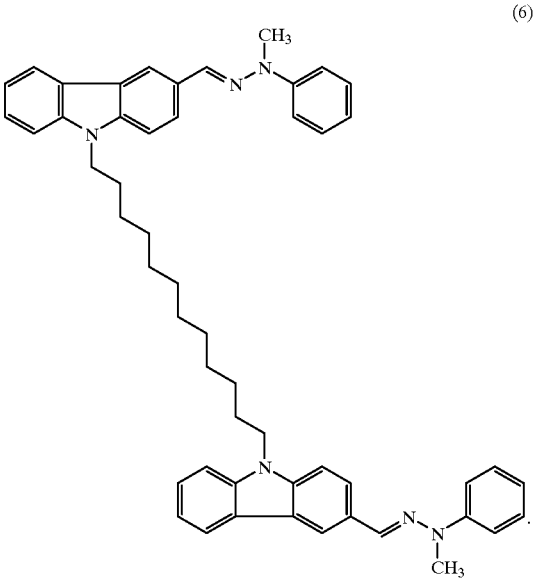
10. The method of claim 1, wherein said charge transport compound has the formula
(7)
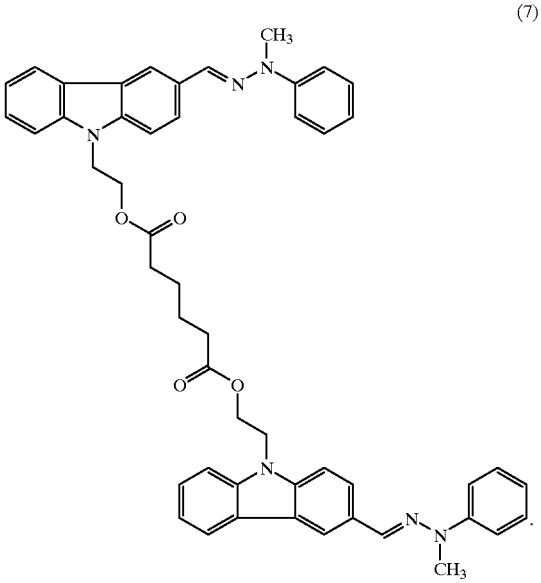
11. The method of claim 1, wherein said charge transport compound has the formula
(8)
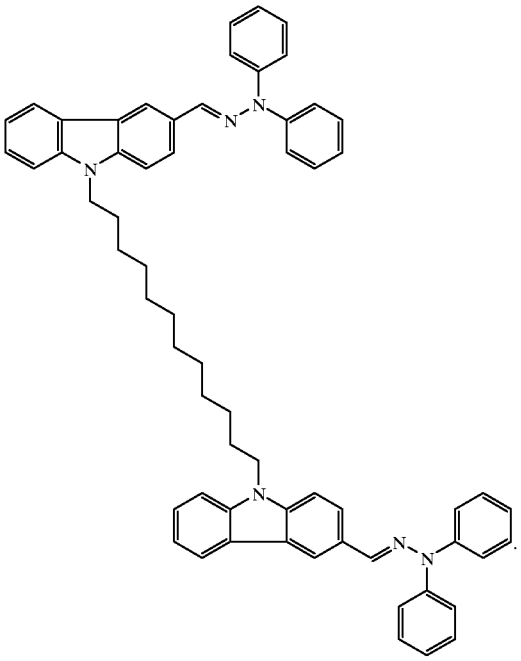

12. The method of claim 1, wherein said charge transport compound has the formula
(9)
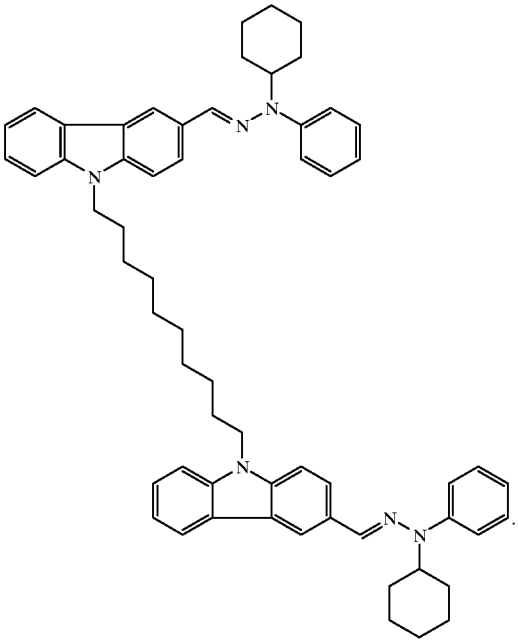
13. The method of claim 1, wherein said charge transport compound has the formula
(10)
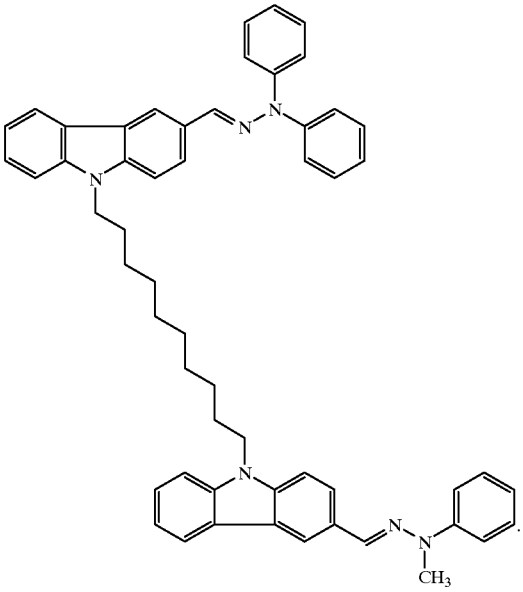
14. The method of claim 1, wherein said charge transport compound has the formula
(11)
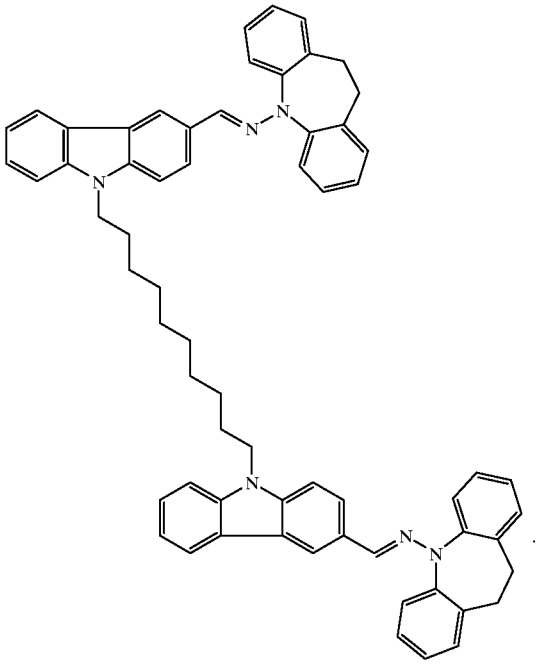
15. The method of claim 1, wherein said charge transport compound has the formula
(12)
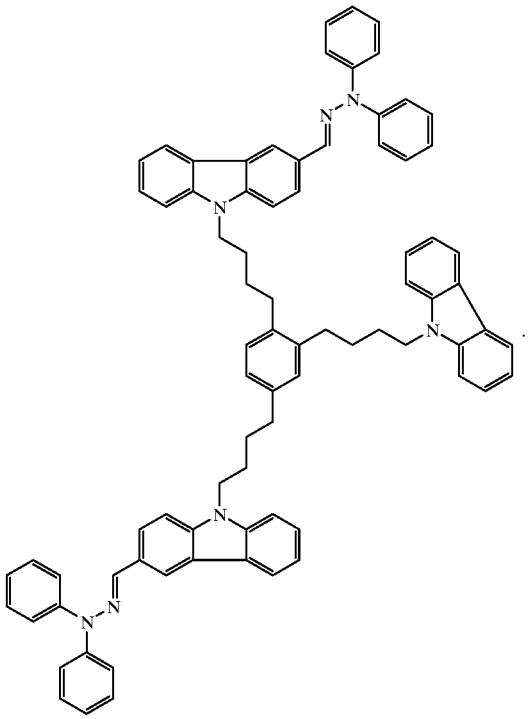

16. The method of claim 1, wherein said charge transport compound has the formula
(13)
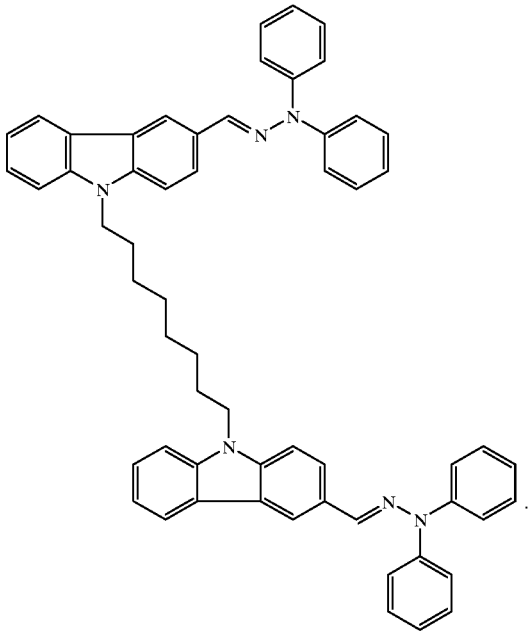
17. The method of claim 1, wherein said charge transport compound has the formula
(14)
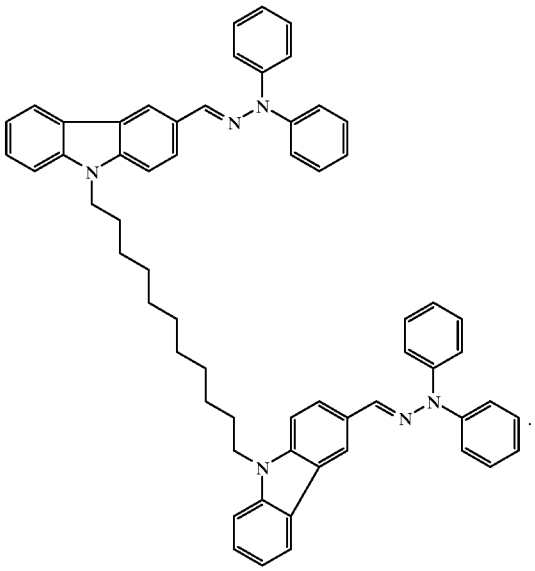
18. The method of claim 1, wherein said charge transport compound has the formula
(15)
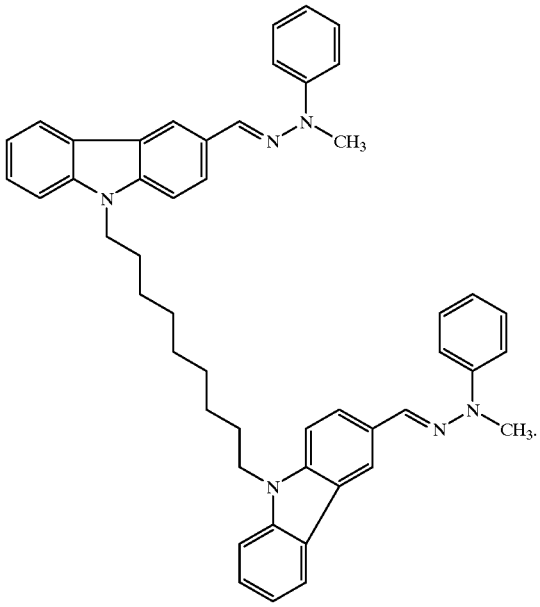
19. The method of claim 1, wherein said charge transport compound has the formula
(16)
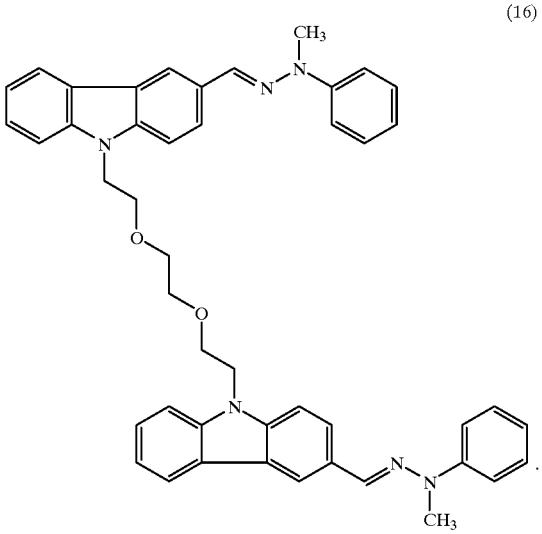

20. The method of claim 1, wherein said charge transport compound has the formula
(17)
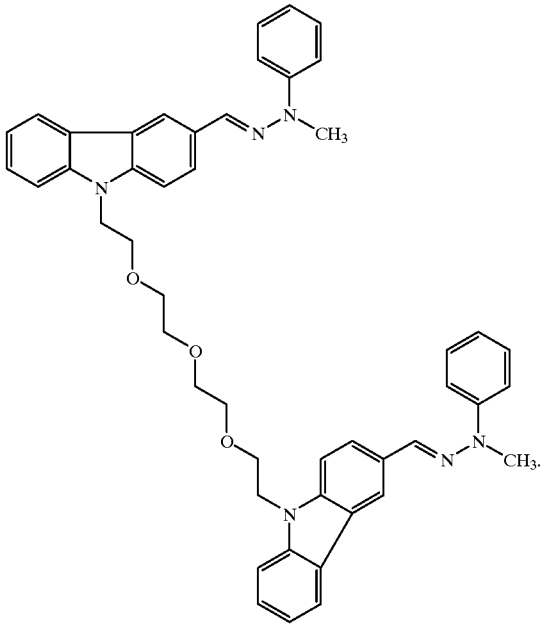
* * * * *

UNITED STATES PATENT AND TRADEMARK OFFICE

CERTIFICATE OF CORRECTION

PATENT NO. : 6,140,004
DATED : October 31, 2000
INVENTOR(S) : Mott et al.

It is certified that error appears in the above-identified patent and that said Letters Patent is hereby corrected as shown below:

Column 8,
Formula (12),

"

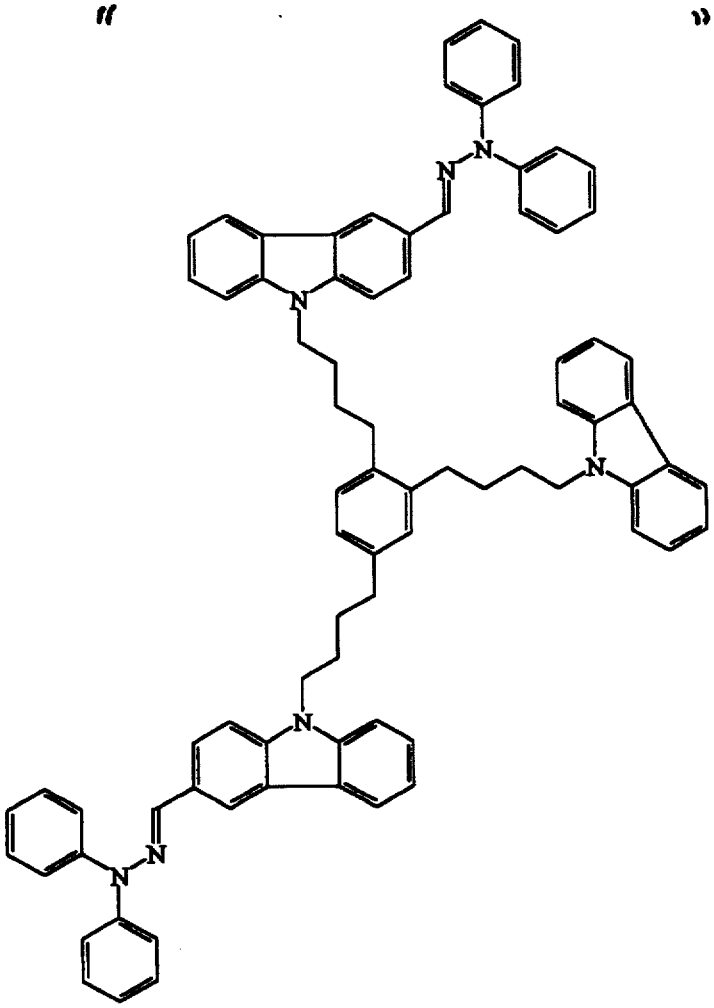

"

UNITED STATES PATENT AND TRADEMARK OFFICE

CERTIFICATE OF CORRECTION

PATENT NO. : 6,140,004
DATED : October 31, 2000
INVENTOR(S) : Mott et al.

It is certified that error appears in the above-identified patent and that said Letters Patent is hereby corrected as shown below:

should be

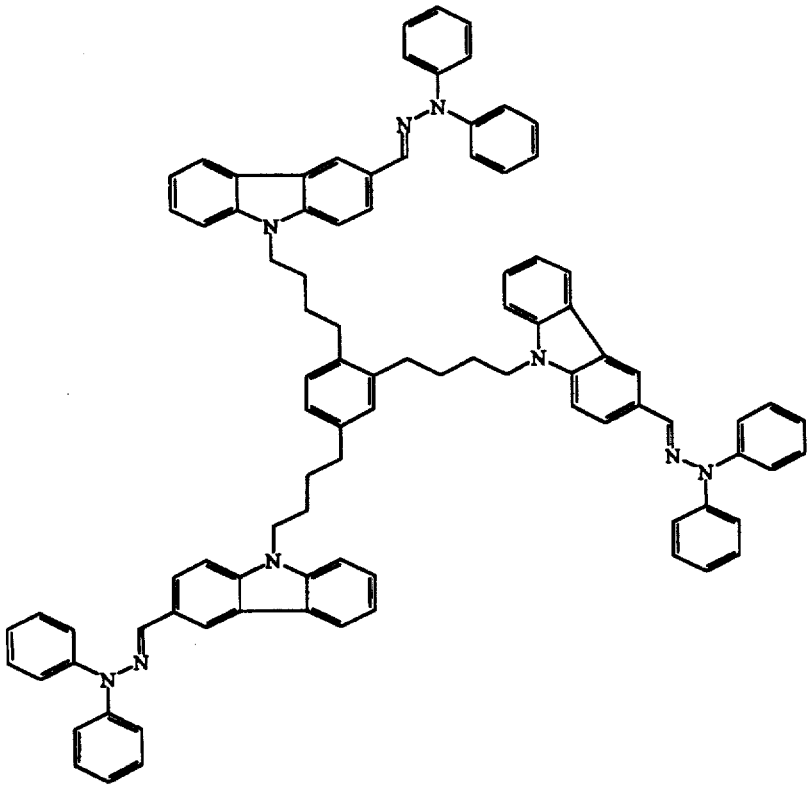

UNITED STATES PATENT AND TRADEMARK OFFICE

CERTIFICATE OF CORRECTION

PATENT NO. : 6,140,004
DATED : October 31, 2000
INVENTOR(S) : Mott et al.

It is certified that error appears in the above-identified patent and that said Letters Patent is hereby corrected as shown below:

Column 28,
Lines 60/61, "organphotoreceptor" should be -- organophotoreceptor --.

Column 24, claim 15,
Formula (12),

"

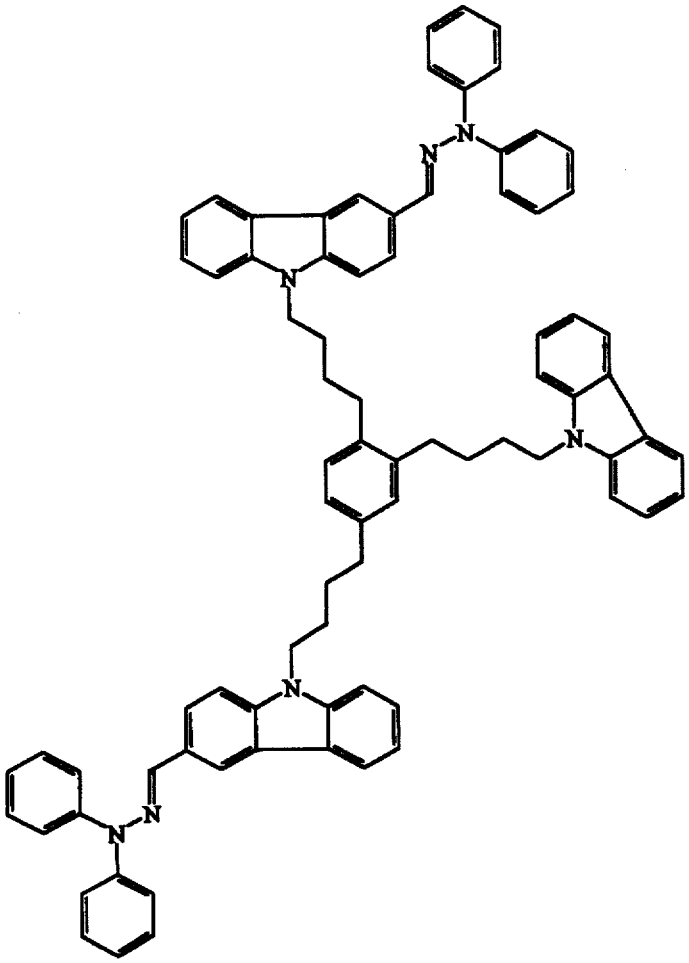

"

UNITED STATES PATENT AND TRADEMARK OFFICE

CERTIFICATE OF CORRECTION

PATENT NO. : 6,140,004
DATED : October 31, 2000
INVENTOR(S) : Mott et al.

It is certified that error appears in the above-identified patent and that said Letters Patent is hereby corrected as shown below:

should be

-- --

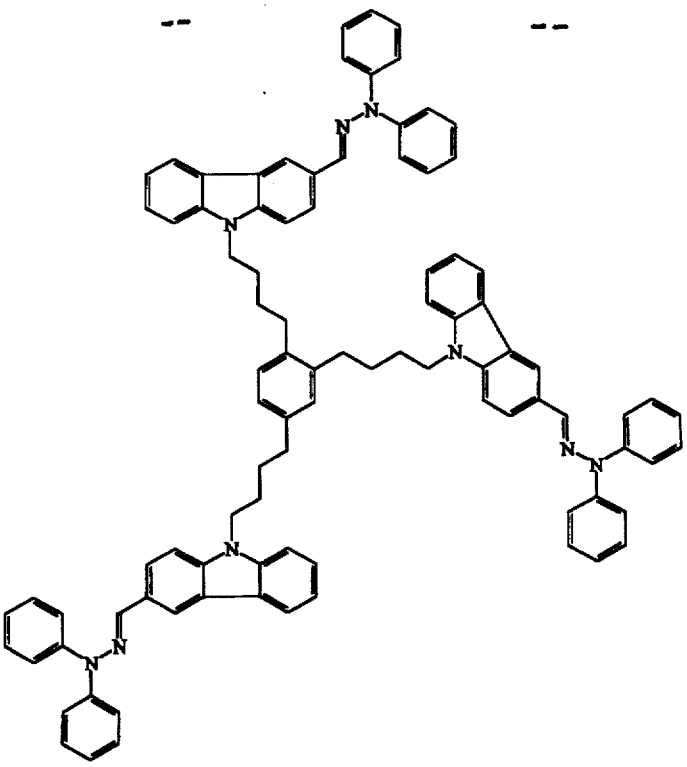

Signed and Sealed this

Thirteenth Day of November, 2001

*Attest:*

Nicholas P. Godici

NICHOLAS P. GODICI

*Attesting Officer*

*Acting Director of the United States Patent and Trademark Office*